US011988436B2

(12) United States Patent
Park

(10) Patent No.: US 11,988,436 B2
(45) Date of Patent: May 21, 2024

(54) REFRIGERATOR WITH A HIDDEN DISPLAY

(71) Applicant: LG Electronics Inc., Seoul (KR)

(72) Inventor: Jongkwon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 17/337,843

(22) Filed: Jun. 3, 2021

(65) Prior Publication Data

US 2021/0381751 A1 Dec. 9, 2021

(30) Foreign Application Priority Data

Jun. 3, 2020 (KR) ..... 10-2020-0067098

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01); *F25D 2327/00* (2013.01); *F25D 2400/361* (2013.01)

(58) Field of Classification Search
CPC .. F25D 23/087; F25D 29/005; F25D 2400/36; F25D 2400/361; F25D 23/028; F25D 23/064; B29L 2031/724
See application file for complete search history.

(56) References Cited

U.S. PATENT DOCUMENTS

2011/0174008 A1 7/2011 Kim
2011/0261544 A1 10/2011 Kelly
2012/0102981 A1* 5/2012 Klein ..... F25B 49/043 62/208
2015/0192352 A1* 7/2015 Sung ..... F25D 23/028 29/890.035
2016/0131420 A1* 5/2016 Park ..... F25D 23/028 62/267
2017/0074576 A1* 3/2017 Lee ..... F25D 17/045
2018/0189027 A1* 7/2018 Jeon ..... F25D 29/00
2019/0226757 A1 7/2019 Park

FOREIGN PATENT DOCUMENTS

| | | |
|---|---|---|
| DE | 3404256 | 8/1985 |
| EP | 2891854 | 7/2015 |
| EP | 3460367 | 3/2019 |
| KR | 100193175 | 6/1999 |
| KR | 20110084789 | 7/2011 |

(Continued)

OTHER PUBLICATIONS

Office Action in Korean Appln. No. 10-2020-0067098, dated Jul. 20, 2021, 12 pages (with English translation).

(Continued)

*Primary Examiner* — Lionel Nouketcha
(74) *Attorney, Agent, or Firm* — Fish & Richardson P.C.

(57) ABSTRACT

A refrigerator includes a cabinet having a storage space, a door configured to open or close the storage space, a display assembly detachably coupled to the door, and a display window disposed on a front surface of the door and having a transmission part capable of transmitting light. The display assembly includes a first display disposed to correspond to the transmission part and a second display disposed not to correspond to the transmission part.

18 Claims, 18 Drawing Sheets

(56) References Cited

FOREIGN PATENT DOCUMENTS

| | | |
|---|---|---|
| KR | 20140121753 | 10/2014 |
| KR | 20150082062 | 7/2015 |
| KR | 1020170040710 | 4/2017 |
| KR | 101815383 | 1/2018 |
| KR | 20190072695 | 6/2019 |

OTHER PUBLICATIONS

Extended European Search Report in European Appln. No. 21177085.4 dated Oct. 29, 2021, 8 pages.
Notice of Allowance in Korean Appln. No. 10-2020-0067098, dated Mar. 3, 2022, 8 pages (with English translation).

* cited by examiner

REFRIGERATOR WITH A HIDDEN DISPLAY

CROSS-REFERENCE TO RELATED APPLICATION

The present application claims priority under 35 U.S.C. 119 and 35 U.S.C. 365 to Korean Patent Application No. 10-2020-0067098, filed on Jun. 3, 2020, which is hereby incorporated by reference in its entirety.

TECHNICAL FIELD

The present disclosure relates to a refrigerator.

BACKGROUND

In general, refrigerators are home appliances for storing food at a low temperature in a storage space that is covered by a door. To store food in an optimual statue, refrigerators can operate to cool the storage space by using cold air generated through heat exchange with a refrigerant circulating through a refrigeration cycle.

Refrigerators have become increasingly multi-functional with changes of dietary lives and gentrification of products. Refrigerators have been released with various structures and convenience devices to improve users' convenience efficient use of internal spaces.

Refrigerators can include a display for displaying an operating state of a refrigerator on a door. The display may display a variety of information related to the operation of the refrigerator in the form of numerals, letters, symbols, or pictures. Users may check the information output through the display to determine the operating state of the refrigerator, and control the operation of the refrigerator.

Some refrigerators provide a front surface of a refrigerator door that is defined by an outer plate made of a metal material, and a display part that is provided at the outer plate by a plurality of through holes. A display assembly including a light emitting part is mounted inside the door, such that light emitted from the light emitting part can pass through the through holes of the outer plate.

In such refrigerators, a set of through holes may be arranged in a seven-segment form. Based on an error code or a specific mode operation, numerals and/or letters can be output so that a user can recognize such an error code or specific mode operation.

However, the through holes at the outer plate require an additional process of forming the through holes, and may deteriorate an aesthetic sense when viewed from the outside.

In addition, an mounting structure of the display assembly is complicated in these refregerators, and it is difficult to align the through holes and the light emitting part of the display assembly. The light emitting part emits light that is transmitted through some of the through holes to the outside. When the through holes of the outer plate are not properly aligned with the light emitting part of the display assembly, accurate information may not be displayed because the light can be transmitted through through holes other than those originally intended.

SUMMARY

Implementations of the present disclosure provide a refrigerator having a display assembly with a hidden display. The display assembly includes a first display that is capable of displaying an error code as well as current state information of the refrigerator, and further includes a second display that is not exposed to the outside.

Implementations of the present disclosure provide a refrigerator with a hidden display that permits an operator to easily check information through the hidden display when a display assembly including the hidden display is separated from a door during a service process.

Implementations of the present disclosure provide a refrigerator with structures that permit light emitting parts, light guide holes, and light guides to be stably aligned with one another.

Particular implementations of the present disclosure provide a refrigerator that includes a cabinet defining a storage space, a door configured to open or close the storage space, a display assembly detachably coupled to the door, and a display window disposed at a front surface of the door. The display window may include a transmission part configured to transmit light therethrough. The display assembly may include (i) a first display disposed at a first position that corresponds to the transmission part and (ii) a second display disposed at a second position that is different from the first position.

In some implementations, the refrigerator can optionally include one or more of the following features. The display assembly may include a display printed circuit board (PCB) that includes the first display and the second display, and a display frame that mounts the display PCB. Each of the first display and the second display may include a plurality of light emitting parts. The display frame may include a first light guide configured to guide light of the light emitting parts of the first display, and a second light guide configured to guide light of the light emitting parts of the second display. Each of the first light guide and the second light guide may include a plurality of guide holes. The plurality of guide holes of the second light guide may be disposed in a seven-segment form. The display frame may include a diffusion sheet disposed at a position that corresponds to the second light guide. The display frame may define a seating groove. The second light guide may be positioned at the seating groove. The diffusion sheet may be seated at the seating groove and covers the second light guide. The door may include a display case configured to accommodate the display assembly, and a display cover disposed in the display case and configured to mount the display assembly. The display assembly may be configured to slide with respect to the display cover to be mounted to the display cover. The display cover may include a cover front surface and a cover circumferential surface. The cover front surface may include a cover light guide that corresponds to the first light guide. Based on the display assembly being mounted at the display cover, the first light guide may be aligned with the cover light guide and the second light guide may be covered and hidden by behind the cover front surface. The first display may be configured to display an operating state of the refrigerator and an error code. The second display may be configured to display at least one of (i) test result information of a control program configured to control the refrigerator, (ii) a mode during an operation test of the refrigerator, or (iii) mode information during a program update process. The display cover may include a cover front surface including (i) a cover light guide configured to guide light emitted from the plurality of light emitting parts of the first display, and (ii) a sensor assembly mounting part being disposed at a side of the cover light guide and mounting a touch sensor assembly. A cover circumferential surface may extend from a circumference of the cover front surface. The display frame may include (i) a frame light guide disposed at a position corresponding to the cover light guide, and (ii) an accommodating part disposed at a first side of the frame light guide and configured to accommodate the sensor assembly mounting part. The sensor assembly mounting part may be recessed from the cover front surface. The display cover may include a cover rear surface extending from the cover circumferential surface and spaced apart from the cover front surface. The display frame may include (i) a first side extension part disposed at a second side of the frame light guide, the second side being opposite to the first side of the frame light guide, and (ii) a second side extension part disposed at a side of the accommodating part. Each of the first side extension part and the second side extension part may be configured to slide and be inserted into a space between the cover front surface and the cover rear surface. The cover rear surface may include a cover protrusion configured to press the first side extension part and the second side extension part toward the cover light guide. The display frame may include a first guide disposed between the first side extension part and the second side extension part. The display cover may include a second guide aligned with the first guide based on the display frame being mounted at the display cover. The first side extension part and the second side extension part may include a pressing protrusion configured to contact the cover rear surface. The display frame may include a first guide disposed between the first side extension part and the second side extension part. The display cover may include a second guide aligned with the first guide based on the display frame being mounted at the display cover. The first guide may include (i) a first extension part extending from the frame light guide toward the accommodating part, and (ii) a first protrusion extending in a first direction crossing the first extension part. The second guide may include (i) a second extension part extending from a mounting wall that receives the touch sensor assembly, and (ii) a second protrusion extending from the second extension part in a second direction crossing the second extension part. Based on the display frame being mounted at the display cover, the first protrusion may be aligned with the second protrusion. The display window may include a first display group and a second display group. The second display group may be separated from the first display group. Each of the first display group and the second display group may include a plurality of transmission parts. The first display group may be configured to display, based on an operation of the first display, first information. The second display group may be configured to display, based on the operation of the first display, second information. The first information may be configured to include one or more numerals or one or more letters. The second information may be configured to, based on the first information including the one or more numerals, include the one or more letters, and configured to, based on the first information including the one or more letters, include the one or more numerals.

Particular implementations of the present disclosure provide a refrigerator that include a cabinet defining a storage space, a door configured to open or close the storage space, a display assembly coupled to the door and configured to be detached from the door, and a display window disposed at a front surface of the door. The display window may include a transmission part configured to transmit light therethrough. The display assembly may include (i) a first display disposed at a first position that corresponds to the transmission part and configured to display first information, and (ii) a second display configured to display second information that is different from the first information. The first display may be configured to operate based on the display assembly being coupled to the door. The second display may be configured to operate based on the display assembly being detached from the door.

According to one aspect, a refrigerator includes a cabinet having a storage space, a door configured to open or close the storage space, a display assembly detachably coupled to the door, and a display window disposed on a front surface of the door and having a transmission part capable of transmitting light.

The display assembly may include a first display disposed to correspond to the transmission part and a second display disposed not to correspond to the transmission part.

The display assembly may include a display PCB provided with the first display and the second display, and a display frame on which the display PCB is mounted.

Each of the first display and the second display may include a plurality of light emitting parts.

The display frame may include a first light guide configured to guide light of the light emitting parts of the first display, and a second light guide configured to guide light of the light emitting parts of the second display.

Each of the first light guide and the second light guide may include a plurality of guide holes.

The second light guide may be disposed in a seven-segment form.

The display frame may further include a diffusion sheet disposed at a position corresponding to the second light guide.

A recessed seating groove may be defined in a front surface of the display frame. The second light guide may be provided in the recessed seating groove, and the diffusion sheet may be seated on the received seating groove to cover the second light guide.

The door may include a display case configured to define a space for accommodating the display assembly, and a display cover which is disposed in the display case and on which the display assembly is slidingly mounted.

The display cover may include a cover front surface and a cover circumferential surface.

The cover front surface may include a cover light guide corresponding to the first light guide.

When the display assembly is mounted on the display cover, the first light guide may be aligned with the cover light guide, and the second light guide may be covered by the cover front surface such that the second light guide is prevented from being exposed to outside.

The first display may be configured to display an operating state of the refrigerator and an error code. The second display may be configured to display test result information of a control program for controlling the refrigerator, display a mode during an operation test of the refrigerator, or display mode information that operates during a program update process.

The display cover may include: a cover front surface having a cover light guide configured to guide light emitted from the light emitting part of the first display, and a sensor assembly mounting part which is disposed at one side of the cover light guide and on which a touch sensor assembly is mounted; and a cover circumferential surface extending from a circumference of the cover front surface.

The display frame may include a frame light guide disposed at a position corresponding to the cover light guide, and an accommodating part disposed at one side of the frame light guide to accommodate the sensor assembly mounting part.

The sensor assembly mounting part may be recessed rearward from the cover front surface.

The display cover may include a cover rear surface extending from the cover circumferential surface and spaced apart from the cover front surface.

The display frame may include a first side extension part disposed at the other side of the frame light guide, and a second side extension part disposed at one side of the accommodating part.

Each of the first side extension part and the second side extension part may be slidingly inserted into a space between the cover front surface and the cover rear surface.

A cover protrusion configured to press the first and second side extension parts toward the cover light guide may be provided on the cover rear surface.

The display frame may further include a first guide disposed between the first side extension part and the second side extension part. The display cover may further include a second guide aligned with the first guide in a state in which the display frame is mounted on the display cover.

The first side extension part and the second side extension part may be provided with a pressing protrusion contacting the cover rear surface.

The first guide may include an extension part extending horizontally from the frame light guide toward the accommodating part, and a first protrusion extending in a direction crossing the extension part.

The second guide may include an extension part extending from a mounting wall on which the touch sensor assembly is seated on the accommodating part, and a second protrusion extending from the extension part in a direction crossing the extension part.

When the display frame is mounted on the display cover, the first protrusion may be aligned with the second protrusion.

The display window may include a first display group and a second display group that are separated from each other. Each of the first display group and the second display group may include a plurality of transmission parts.

First information may be displayed on the first display group and second information may be displayed on the second display group, according to an operation of the first display.

The first information may include one of a numeral and an letter, and the second information may include the other of the numeral and the letter.

According to another aspect, a refrigerator includes a cabinet having a storage space, a door configured to open or close the storage space, a display assembly detachably coupled to the door, and a display window disposed on a front surface of the door and having a transmission part capable of transmitting light.

The display assembly may include a first display disposed to correspond to the transmission part, and a second display configured to display different information from the second display. The first display may operate in a state in which the display assembly is mounted on the door, and the second display may operate when the display assembly is separated from the door.

The details of one or more implementations are set forth in the accompanying drawings and the description below. Other features will be apparent from the description and drawings, and from the claims.

DETAILED DESCRIPTION OF THE IMPLEMENTATIONS

Figure 1:
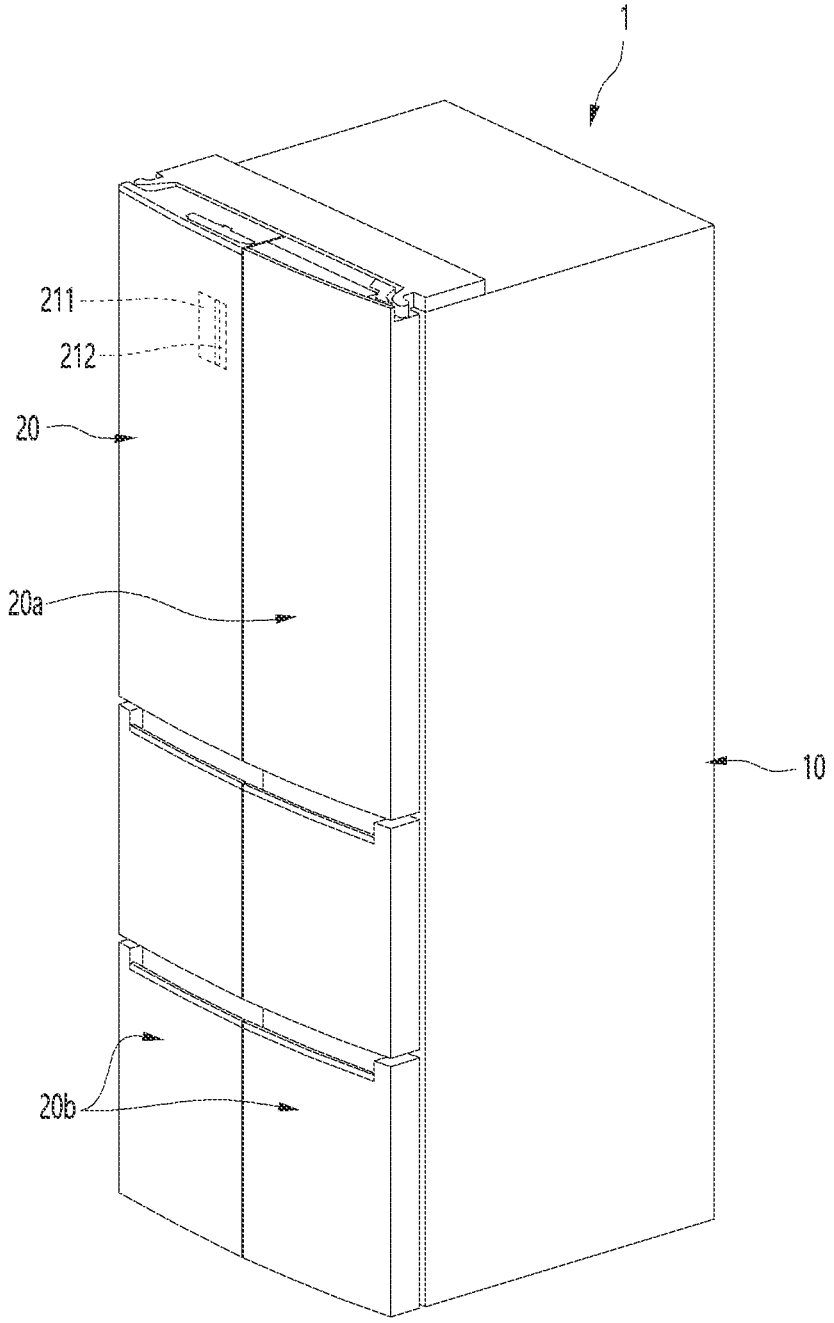
FIG. 1 is a perspective view of a refrigerator according to an implementation of the present disclosure.

Hereinafter, some implementations of the present disclosure will be described in detail with reference to exemplary drawings. It should be noted that same components are designated by same reference numerals to the extent possible although illustrated in different drawings. In addition, a detailed description of well-known configurations or functions may be omitted when it is obvious to those of ordinary skill in the art.

In the illustrated implementations, it is primarily described that a display is provided at one of a pair of refrigerator doors in a bottom freeze-type refrigerator. However, it should be noted that the display according to the present disclosure can be applied to any types of refrigerators with different configurations of doors.

FIG. 1 is a perspective view of a refrigerator according to an implementation of the present disclosure.

Referring to FIG. 1, the refrigerator 1 may include the cabinet 10 defining a storage space, and the door 20 mounted on the front surface of the cabinet 10 to open or close the storage space.

The storage space of the cabinet 10 may be vertically partitioned. A first storage space disposed at an upper side may be opened or closed by a plurality of rotatable doors 20*a*.

One or more second storage spaces may be provided below the first storage space, and the second storage space may be opened or closed by drawer-type doors 20*b*.

In some implementations, a dispenser for dispensing water and/or ice may be provided on the front surface of the door 20*a*.

A display window 211 and a touch operation module 212 may be provided on the door 20. In the door 20, the display window 211 and the touch operation module 212 may be positioned at a height that can facilitate a user's operation and identification.

Hereinafter, the structures of the display window 211 and the touch operation module 212 will be described.

For example, the display window 211 and the touch operation module 212 may be provided on a door 20*a* that opens or closes the first storage space.

Figure 2:
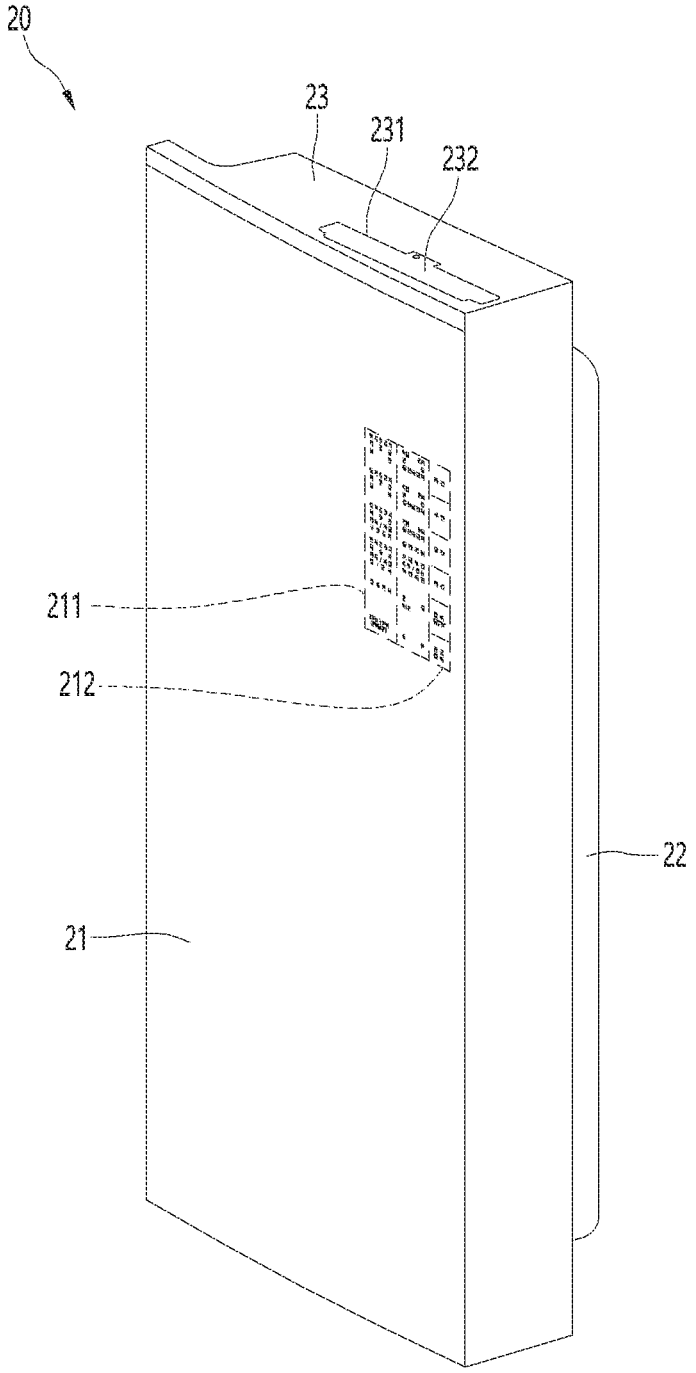
FIG. 2 is a perspective view of a door of the refrigerator.
Figure 3:
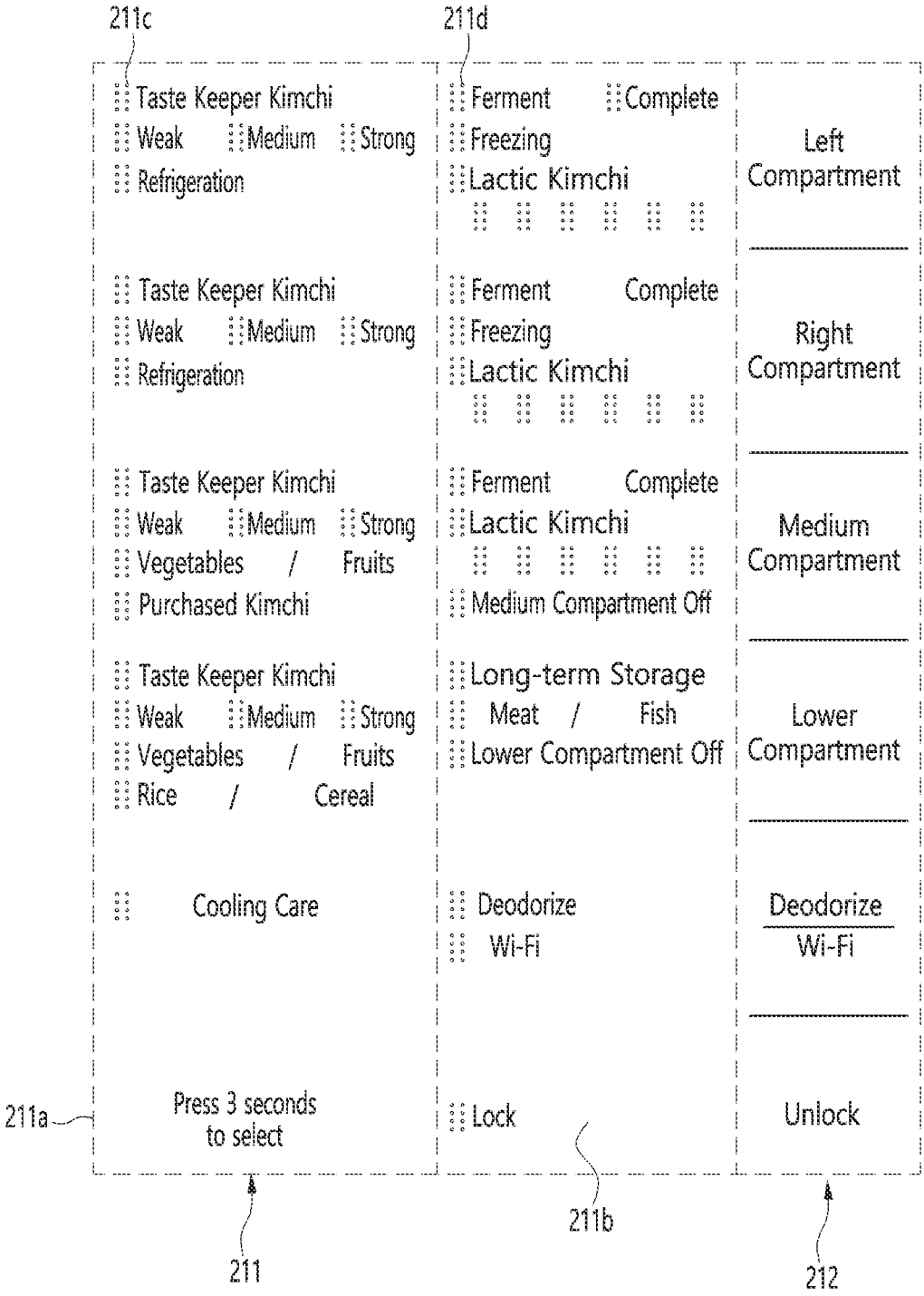
FIG. 3 is an enlarged view of a display window and a touch operation module of the door.

FIG. 2 is a perspective view of the door 20 of the refrigerator. FIG. 3 is an enlarged view of the display window 211 and the touch operation module 212 of the door 20.

Referring to FIGS. 2 and 3, an overall appearance of the door 20 may be defined by a combination of an outer plate 21 defining a front appearance, a door liner 22 defining a rear appearance, and a cap decoration 23 provided at the upper and lower ends of the door 20.

The outer plate 21 defines the front appearance of the door 20 and may be made of a plate-shaped metal material. The outer plate 21 may be made of a stainless steel plate or a color steel plate (VCM, PCM) formed to have a stainless steel texture. For example, the outer plate 21 may be formed to have a thickness of about 0.5 mm. Anti-fingerprint processing may be performed on the front surface of the outer plate 21 that is exposed to the outside. A specific color, pattern, or mark may be expressed on the front surface of the outer plate 21. Hairline may be formed on the front surface of the outer plate 21 to have a metal texture.

The display window 211 and the touch operation module 212 may be provided on the outer plate 21.

The display window 211 is configured to display an operating state of the refrigerator 1 to the outside and may transmit light emitted from a light emitting part inside the door 20. Therefore, the display window 211 serves to transmit light.

The display window 211 may include a plurality of transmission parts 211*c* and 211*d* formed in a partial region of the outer plate 21. The display window 211 may include a first display group 211*a* and a second display group 211*b* that are horizontally separated from each other.

The first display group 211*a* may include a plurality of first transmission parts 211*c*, and the second display group 211*b* may include a plurality of second transmission parts 211*d*.

The first and second display groups 211*a* and 211*b* may include letters for displaying information, and the first and second transmission parts 211*c* and 211*d* may be arranged at positions adjacent to the letters. The transmission parts 211*c* and 211*d* may be, for example, transmission holes.

Therefore, when light is emitted from the light emitting part corresponding to specific letters and transmitted through the associated transmission parts 211*c* and 211*b*, the user can determine the current state of the refrigerator by recognizing the specific letters.

The transmission parts 211*c* and 211*d* may be formed by various processes, such as laser processing, etching, or NCT processing. For example, the transmission parts 211*c* and 211*d* are fine in size and are filled with hole filling members. Thus, the transmission parts 211*c* and 211*d* may not be clearly visible or exposed to the outside when the light emitting parts are not turned on. Alternatively, a cover sheet covering the transmission parts 211*c* and 211*d* may be provided on the rear surface of the outer plate 21.

The touch operation module 212 allows the user to input manipulation for the operation of the refrigerator 1. The touch operation module 212 may be provided in a partial region of the front surface of the door 20, and may be disposed at a position adjacent to the display window 211. For example, the touch operation module 212 may be disposed at one side of the display window 211.

The touch operation module 212 may be formed such that a portion for sensing a pressing operation is printed or an operation portion is visible to the user through surface processing such as etching.

A touch sensor assembly 70 (FIG. 5) may be provided inside the door 20 corresponding to the touch operation module 212, and may sense a user's pressing operation of the touch operation module 212.

Hereinafter, the arrangement structure of a display assembly 40 and the touch sensor assembly 70 will be described in more detail with reference to the drawings.

Figure 4:
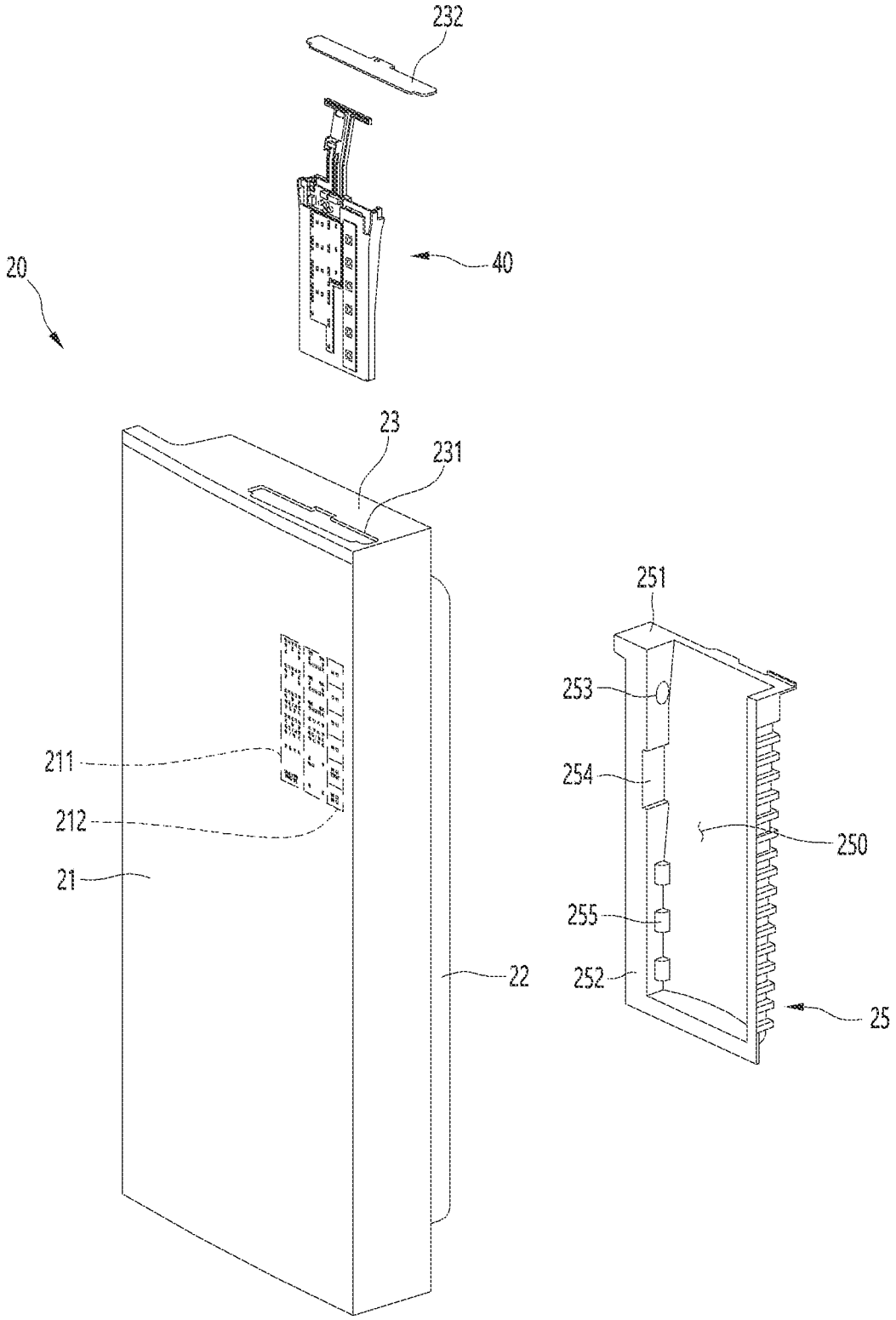
FIG. 4 illustrates that a display assembly is separated from the door.
Figure 5:
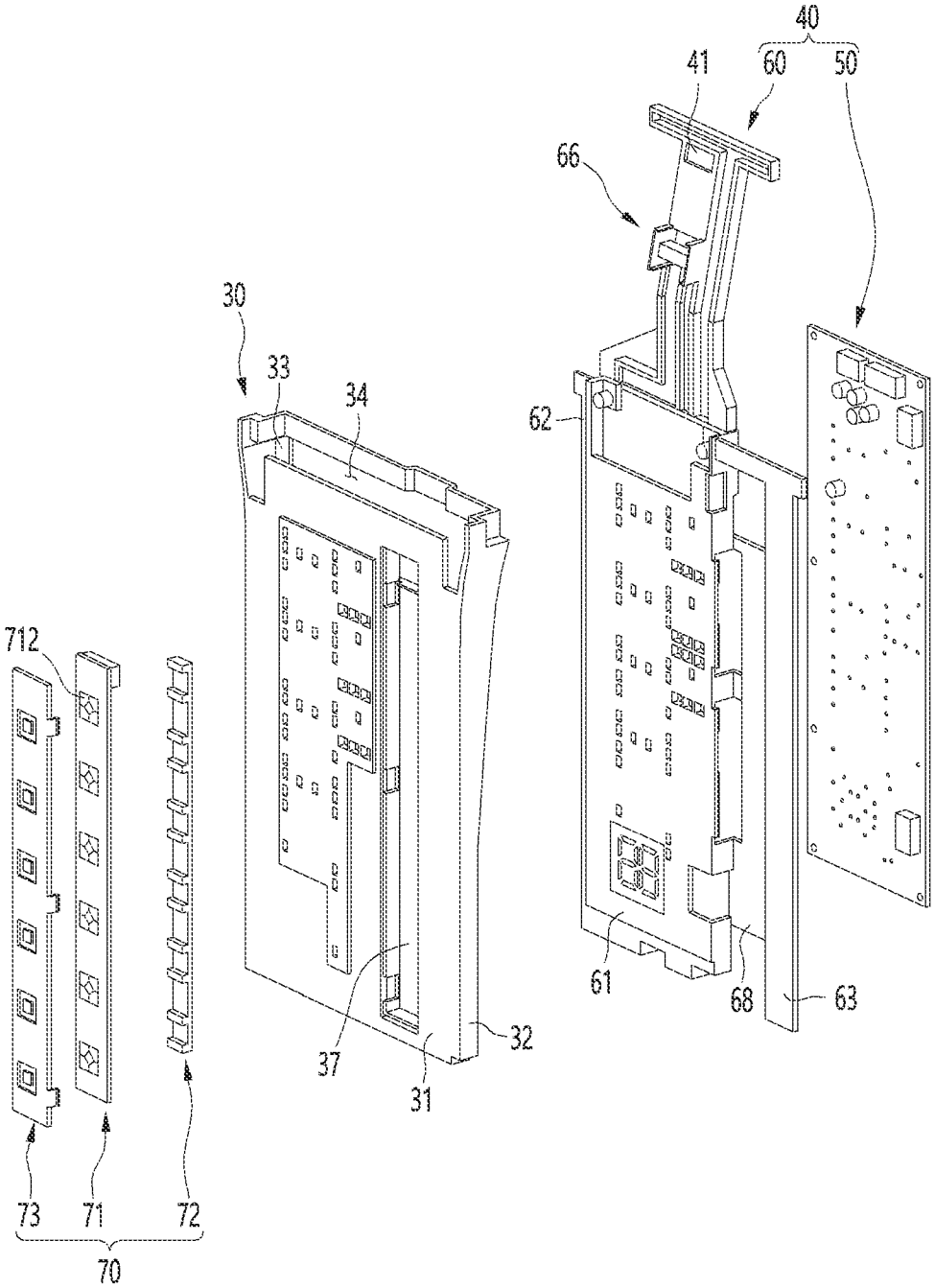
FIG. 5 illustrates a display cover, a display assembly, and a display case.
Figure 6:
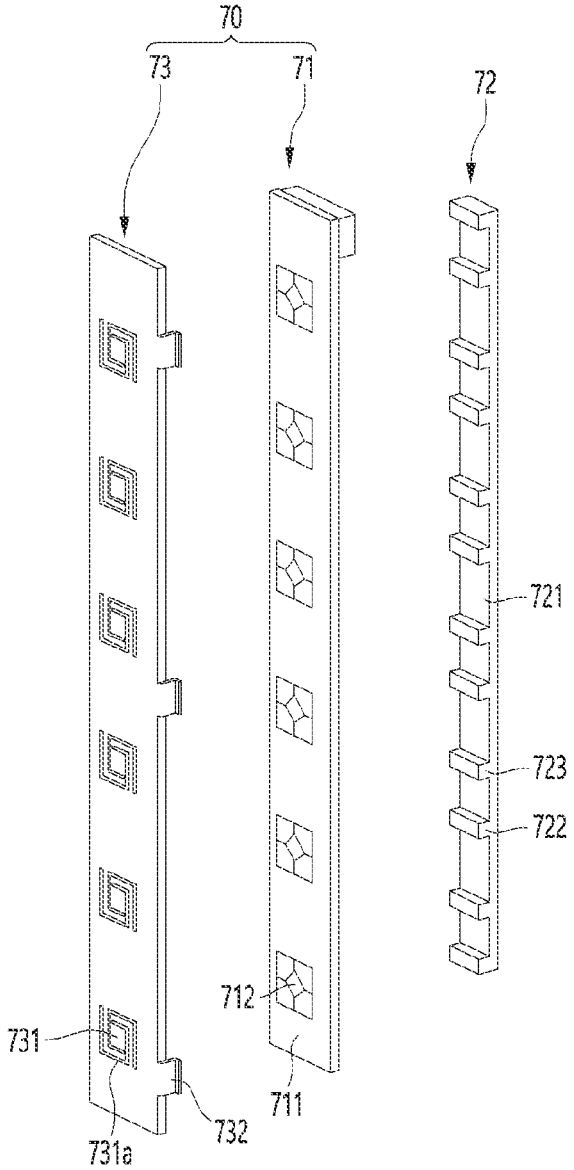
FIG. 6 is an exploded perspective view of a touch sensor assembly.

FIG. 4 illustrates that the display assembly 40 is separated from the door according to the present implementation, and FIG. 5 illustrates a display cover, the display assembly 40, and a display case. FIG. 6 is an exploded perspective view of the touch sensor assembly 70.

Referring to FIGS. 4 to 6, the outer appearance of the door 20 may be defined by the outer plate 21, the door liner 22, and the cap decoration 23. A heat insulation material may be provided in the inner space of the door 20 to which the outer plate 21, the door liner 22, and the cap decoration 23 are coupled. The heat insulation material may be foamed by injecting a foaming liquid.

The display assembly 40 coupled to the display cover 30, and an inner case 25 providing a space for mounting the touch sensor assembly 70 may be provided inside the door 20.

For example, the inner case 25 may have an upper end and a front circumference. The upper end is coupled to the lower surface of the cap decoration 23 and the front circumference is coupled to the outer plate 21 to thereby define a predetermined space. The space defined by the inner case 25 is an independent space such that the foaming liquid does not penetrate when the foaming liquid is injected into the door 20. Accordingly, a space is provided for mounting the display assembly 40 and the touch sensor assembly 70.

The inner case 25 may include a case upper surface 251 and a case front surface 252, and defines a space 250 opened frontward and upward. The case upper surface 251 may contact the cap decoration 23, and the case front surface 252 may contact the rear surface of the outer plate 21.

The case front surface 252 may be formed along the circumference of the inner case 25 except for the upper end of the space 250.

A wire hole 253 may be defined latreally at the upper portion of the inner case 25. Wires are connected to the display assembly 40 and the touch sensor assembly 70 provided inside the inner case 25, and enters and exits through the wire hole 253.

Cover supports 255 may be provided on both left and right sides of the space 250 of the inner case 25, and may protrude inward. The cover supports 255 may support the display cover 30 from the rear such that the display cover 30 is in close contact with the rear surface of the outer plate 21.

A case groove 254 laterally may be provided above the cover supports 255 and may be recessed laterally. The case groove 254 defines a space in which the upper portion of the display cover 30 can be accommodated.

The display cover 30 may be positioned in the space 250 of the inner case 25 so as to mount the display assembly 40. The display cover 30 may be mounted in close contact with the rear surface of the outer plate 21, and the upper surface of the display cover 30 may be opened such that the display assembly 40 can be inserted and mounted from above.

The opened upper surface of the inner case 25 may communicate with a decoration opening 231 defined in the cap decoration 23. The decoration opening 231 may be opened or closed by the decoration cover 232. The display assembly 40 may be inserted into the space 250 of the inner case 25 through the decoration cover 232.

When the upper surface of the display cover 30 is opened, and the display assembly 40 is inserted into the inner case 25, the display assembly 40 can be inserted into the opened upper surface of the display cover 30. The display assembly 40 may be completely inserted into the display cover 30 by its own weight.

When the decoration cover 232 is mounted to shield the decoration opening 231, the lower surface of the decoration cover 232 presses the upper end of the display assembly 40 such that the display assembly 40 can be completely inserted.

The display assembly 40 has a structure that guides the display assembly 40 to be mounted at an accurate position as the display assembly 40 is inserted into the display cover 30. That is, the display assembly 40 and the display cover 30 have a plurality of structures that contact or match each other and thereby permit the display assembly 40 to be mounted at an accurate position of the display cover 30.

When the display assembly 40 is mounted at the accurate position inside the display cover 30, light emitting parts 513 and 514 (FIG. 7) of the display assembly 40, light guides 614 and 615 (FIG. 8), through holes 311 and 312 (FIG. 11), and the transmission parts 211*c* and 211*d* may be aligned to one another.

Therefore, when the light emitting parts 513 and 514 are turned on, light emitted from the light emitting parts 513 and 514 is sequentially transmitted through the light guides 614 and 615 (FIG. 8), the through holes 311 and 312 (FIG. 11), and the transmission parts 211*c* and 211*d*, and is emitted to the outside.

Further, the display assembly 40 and the touch sensor assembly 70 may be mounted on the display cover 30.

Referring to FIG. 5, the display cover 30 may include a cover front surface 31. The cover front surface 31 may be in close contact with the rear surface of the outer plate 21.

The display cover 30 may further include a cover rear surface 33 spaced apart from the cover front surface 31, and a cover circumferential wall 32 connecting the cover front surface 31 to the cover rear surface 33. The cover front surface 31, the cover rear surface 33, and the cover circumferential wall 32 may define a space 34 in which the display assembly 40 is accommodated.

The display cover 30 may include a sensor assembly mounting part 37 on which the touch sensor assembly 70 is mounted. For example, the sensor assembly mounting part 37 may be provided on the cover front surface 31.

The display assembly 40 may include a display printed circuit board (PCB) 50 on which the light emitting parts 513 and 514 are mounted, and a display frame 60 on which the display PCB 50 is fixed and mounted.

The display frame 60 may be inserted from the outside of the door 20 through the decoration opening 231 while the display PCB 50 is fixed to the display frame 60.

The display frame 60 may include a first side extension part 62 and a second side extension part 63 that extend at opposite sides and are spaced apart from each other. The display frame 60 may further include a frame light guide 61 disposed between the first side extension part 62 and the second side extension part 63. The display frame 60 may further include an accommodating part 68 for accommodating the sensor assembly mounting part 37.

The display frame 60 may further include a handle part 66. A Wi-Fi module 41 may be mounted on the handle part 66.

The touch sensor assembly 70 may include a touch PCB 71 on which the touch sensor 712 is mounted, an elastic member 72 elastically supporting the touch PCB 71, and a touch cover 73 shielding the touch PCB 71.

The elastic member 72, the touch PCB 71, and the touch cover 73 may be mounted in order on the sensor assembly mounting part 37.

The elastic member 72 may be fixed and mounted on the mounting wall of the sensor assembly mounting part 37. The elastic member 72 may be made of an elastic material such as rubber, and may press and support the touch PCB 71 from the rear to the front.

Referring to FIG. 6, the elastic member 72 may include a base 721 defining a bottom surface, and support protrusions 722 and 723 protruding forward from the base 721. The base 721 may be formed in a plate shape.

For example, the plurality of support protrusions 722 and 723 may be spaced apart from each other along the base 721 in the vertical direction. Each touch sensor may be disposed at a position that corresponds to a space between adjacent support protrusions 722 and 723. Each of the support protrusions 722 and 723 may extend in a horizontal direction (e.g., across a a width of the elastic member 72).

For example, the support protrusions 722 and 723 may extend in the horizontal direction from one end to the other end of the base 721. The length of the support protrusions 722 and 723 in the horizontal direction may be longer than the diameter of the touch sensor 712.

The touch PCB 71 may be formed in a plate shape that can be accommodated inside the sensor assembly mounting part 37, and that can be entirely supported by the elastic member 72.

A plurality of touch sensors 712 may be provided on the front surface of the touch PCB 71. The touch sensor 712 is a sensor device that receives a touch operation by detecting a change in pressure against the device. In some examples, a general piezo-type touch sensor may be used as the touch sensor 712.

In some implementations, the touch sensor 712 may recognize a user's touch operation by detecting a change in pressure applied thereto through deformation of the outer plate 21 when the user presses the outer plate 21.

A plurality of touch sensors 712 may be disposed in the vertical direction. Each touch sensor 712 may be disposed at a region between adjacent support protrusions 722 and 723. That is, the support protrusions 722 and 723 may be disposed above and below a position adjacent to the position where the touch sensor 712 is mounted. Such arrangements of the support protrusions 722 and 723 permit the pressure applied to the touch sensor 712 to be concentrated to the central portion of the touch sensor 712.

The touch PCB 71 is pressed forward by the elastic member 72, and is further pressed forward by the support protrusions 722 and 723, such that the touch sensor 712 can be in close contact with the rear surface of the touch cover 73. Therefore, the user's touch operation through the touch cover 73 can be detected more effectively.

The touch cover 73 may have a size corresponding to the opened front surface of the sensor assembly mounting part 37. The touch cover 73 may be fixed and mounted onto the sensor assembly mounting part 37. The touch cover 73 may be movable (e.g., coupled to and decoupled from the sensor assembly mounting part 37, and/or movable to a certain extent while engaged with the sensor assembly mounting part 37) in a front-and-rear direction by cover hooks 732 formed at opposite side surfaces of the touch cover 73.

Therefore, it is possible to more closely contact the rear surface of the outer plate 21 while the touch PCB 71 is pressed and supported forward by the elastic member 72. When the outer plate 21 is pressed, the touch sensor 712 may be pressed more effectively while moving backward.

In addition, a touch booster 731 may be disposed in the touch cover 73. The touch booster 731 may be formed to be concentric with the central portion of the touch sensor 712, and may be positioned in front of the touch sensor 712. A plurality of helical booster cutouts 731*a* are formed along the circumference of the touch booster 731. When a pressure is applied to the touch booster 731, the central portion of the touch booster 731 may be moved backward. That is, the touch booster 731 may be moved backward while being elastically deformed by the booster cutouts 731*a*, and may return to its original position when the user releases his/her pressing hand.

In some implementations, a protrusion, which protrudes rearward, may be further formed in the center of the touch booster 731. With the protrusion, when the touch booster 731 is moved backward by the pressing operation of the outer plate 21, the touch sensor 712 may be pressed more effectively.

Figure 7:
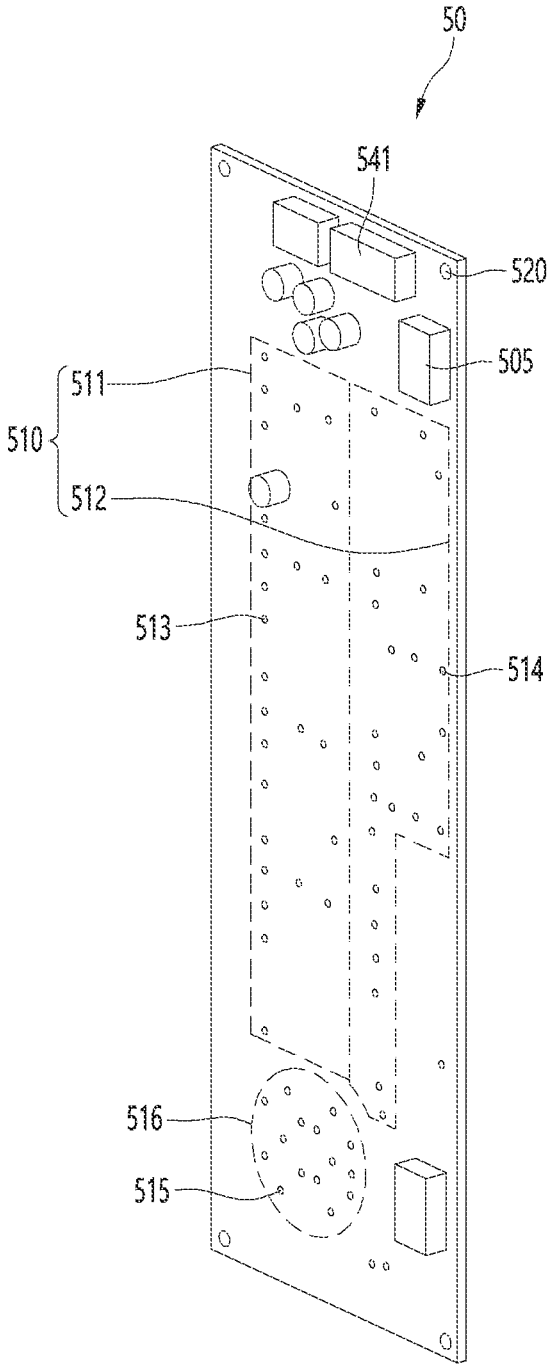
FIG. 7 is a perspective view of a display printed circuit board (PCB).

FIG. 7 is a perspective view of the display PCB 50 according to the present implementation.

Referring to FIG. 7, the display PCB 50 may include a first display 510 and a second display 516.

The first display 510 may include one or more light emitting parts 513 and 514. The second display 516 may include one or more light emitting parts 515.

Light emitted from the light emitting parts 513 and 514 of the first display 510 may be transmitted through the display window 211. For example, the light emitting parts 513 and 514 of the first display 510 may be disposed to correspond to the transmission parts 211*c* and 211*d* of the display window 211. The number of light emitting parts 513 and 514 of the first display 510 may be equal to the number of transmission parts 211*c* and 211*d* of the display window 211. Therefore, the user can recognize the light emitted from the light emitting parts 513 and 514 of the first display 510.

In addition, the light emitting parts 515 of the second display 516 may be disposed so as not to correspond to the transmission parts 211*c* and 211*d* of the display window 211. The second display 516 serves as a hidden display that is invisible from the front of the door.

The first display 510 may be divided into a first light emitting group 511 and a second light emitting group 512. The first light emitting group 511 corresponds to the first display group 211*a*, and the second light emitting group 512 corresponds to the second display group 211*b*.

The first light emitting group 511 may include a plurality of light emitting parts 513. The second light emitting group 512 may include a plurality of light emitting parts 514. The second display 516 may include a plurality of light emitting parts 515. Each of the light emitting parts 513, 514, and 515 may be an LED.

The display PCB 50 may further include a plurality of connectors 541. The connectors 541 may include a touch connector that can be connected to the touch PCB 71, a main connector that can be connected to a main controller of the refrigerator, and a Wi-Fi connector that can be connected to the Wi-Fi module 41. The plurality of connectors 541 may be connected to wires before the display assembly 40 is inserted into the display cover 30.

The display PCB 50 may include a plurality of devices including a microcomputer 505 that controls the operations of the light emitting parts 513, 514, and 515. The display PCB 50 may further include a microcomputer that processes an input signal of the touch sensor 712.

Figure 9:
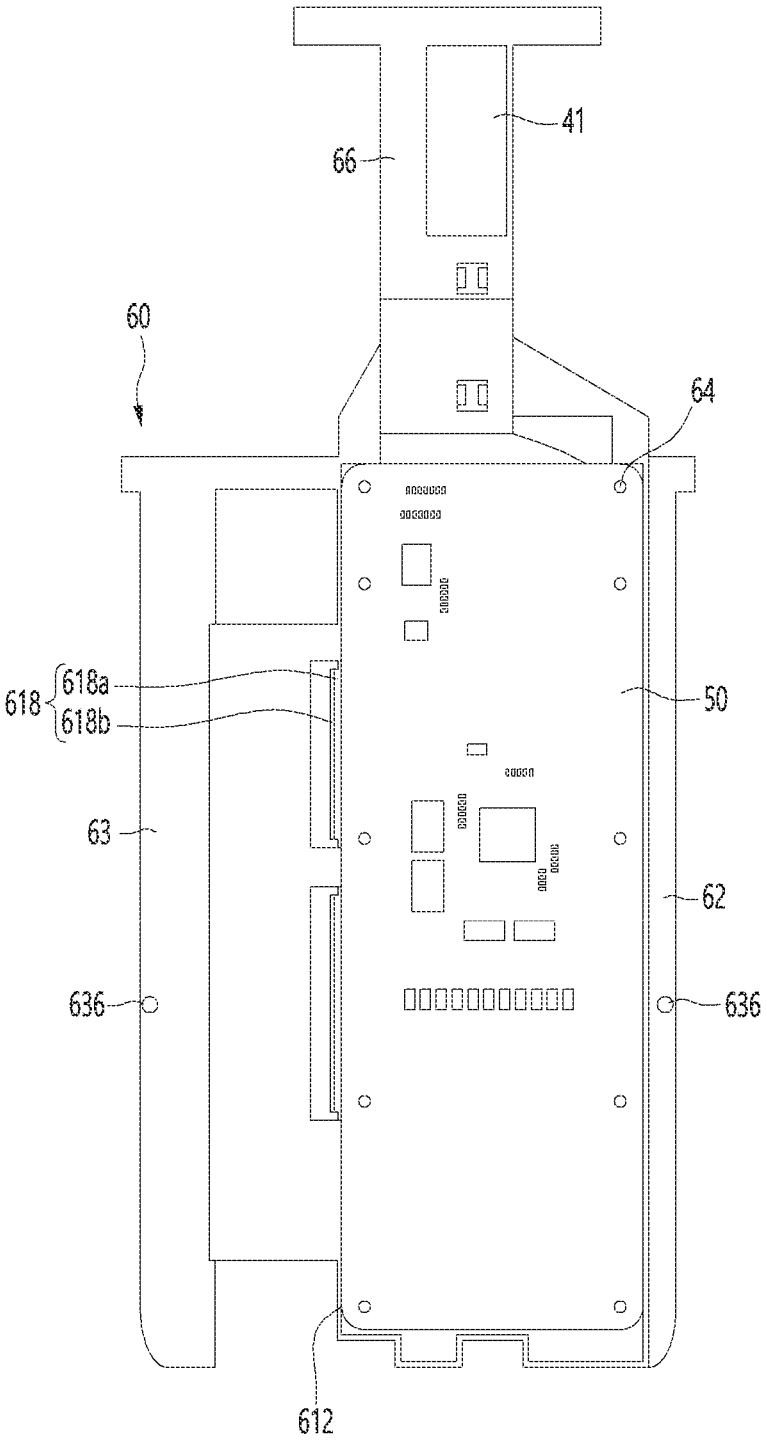
FIG. 9 illustrates that the display PCB is coupled to the display frame.

The display PCB 50 may be formed to be inserted into the display frame 60. A plurality of coupling holes 520 may be defined in the display PCB 50. As shown in FIG. 9, the display frame 60 includes a plurality of coupling protrusions 64. Each coupling protrusion 64 of the display frame 60 is inserted into each coupling hole 520. In some implementations, the end of the coupling protrusion 64 passing through the coupling hole 520 may be fused to be completely coupled to the display PCB 50 at the rear surface of the coupling hole 520.

In some implementations, the plurality of coupling holes 520 may be evenly disposed in the entire region of the display PCB 50. Therefore, the display PCB 50 and the display frame 60 may be firmly fixed to each other.

Figure 8:
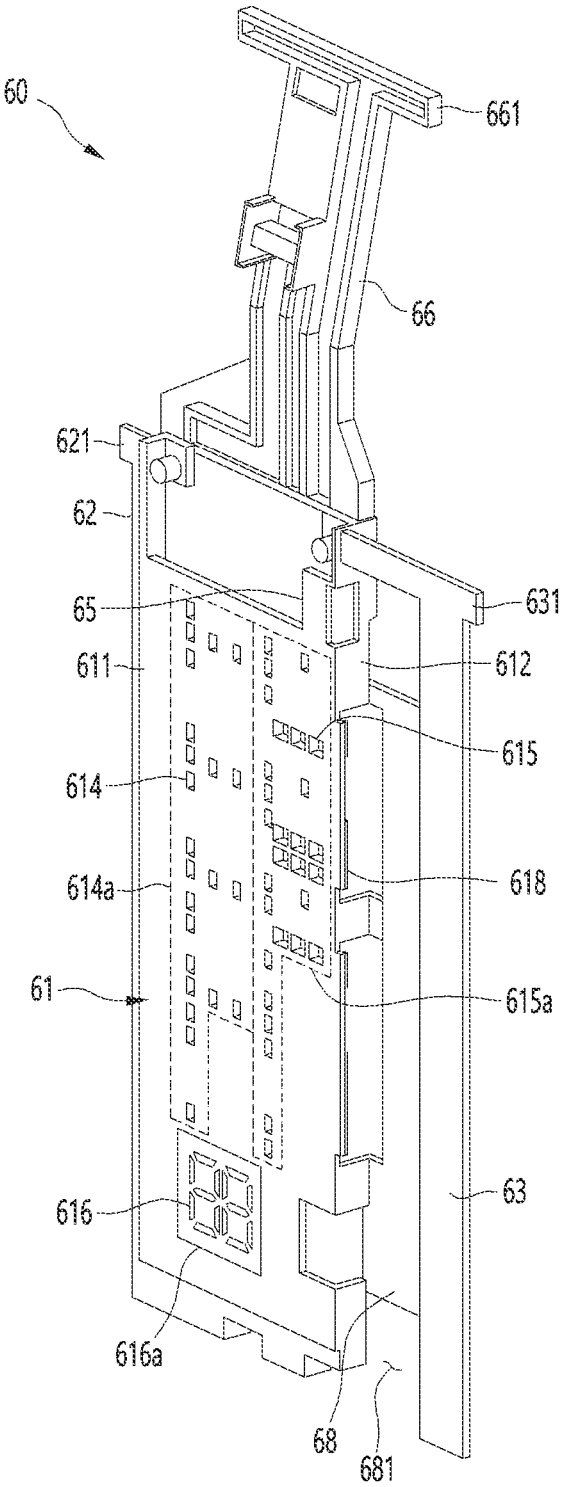
FIG. 8 is a perspective view of a display frame.
Figure 10:
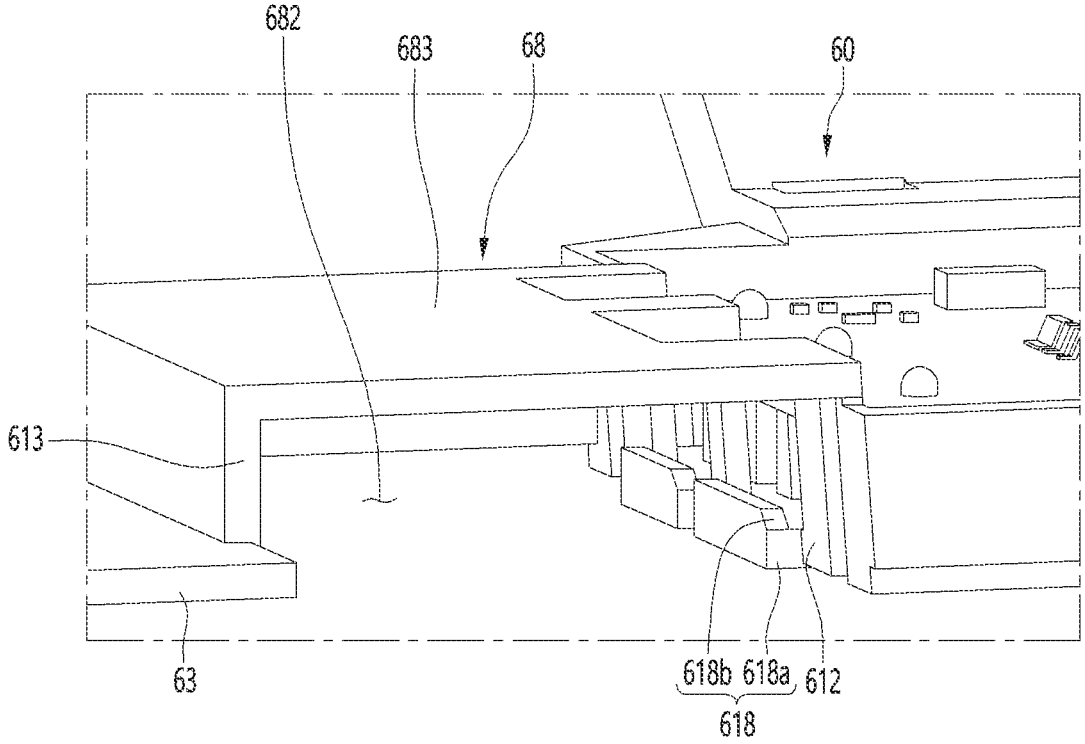
FIG. 10 illustrates a first guide provided in the display frame.

FIG. 8 is a perspective view of the display frame 60 according to the present implementation, FIG. 9 illustrates that the display PCB 50 is coupled to the display frame 60, and FIG. 10 illustrates a first guide provided in the display frame 60.

Referring to FIGS. 8 to 10, the display frame 60 may include a frame light guide 61 and an accommodating part 68 for accommodating the sensor assembly mounting part 37. The accommodating part 68 may be positioned at a side of the frame light guide 61.

The display frame 60 may further include a first side extension part 62 extending vertically at a side of the frame light guide 61, and a second side extension part 63 extending vertically at a side of the accommodating part 68. For example, the first side extension part 62, the frame light guide 61, the accommodating part 68, and the second side extension part 63 may be disposed in order.

As described herein, the handle part 66 may be provided at the upper end of the frame light guide 61. A gripping part 661, which may contact the decoration cover 232, may be formed at the upper end of the handle part 66. The Wi-Fi module 41 may be accommodated on the rear surface of the handle part 66.

A frame opening 65 through which the display PCB 50 is exposed may be defined in the upper portion of the frame light guide 61. Elements including the microcomputer 505 are disposed at a portion of the display PCB 50 that is exposed through the frame opening 65 and can be visible through the frame opening 65.

The frame light guide 61 may include first light guides 614*a* and 615*a* configured to guide the light emitted from the light emitting parts 513 and 514 of the first display 510, and a second light guide 616 configured to guide the light emitted from the light emitting parts 515 of the second display 516.

The first light guides 614*a* and 615*a* may include a first guide group 614*a* corresponding to the first light emitting group 511, and a second guide group 615*a* corresponding to the second light emitting group 512. The first and second guide groups 614*a* and 615*a* may include the same numbers of guide holes 614 and 615 as the numbers of light emitting parts 513 and 514, respectively.

The second light guide 616 may include the same number of guide holes as the number of light emitting parts 515 of the second display 516. The guide holes of the second light guide 616 may be arranged in, for example, a seven-segment form. In the illustrated example of FIG. 8, the guide holes of the second light guide 616 may be arranged to form two seven-segment forms of a plurality of guide holes.

The frame light guide 61 may be provided with a recessed seating groove 616*a* on which a diffusion sheet (described later) is seated, and the second light guide 616 may be provided on the recessed seating groove 616*a*. That is, the plurality of guide holes may pass through the recessed seating groove 616*a*.

A circumferential wall 612 of the frame light guide 61 may define an accommodation space in which the display PCB 50 is accommodated. The accommodation space may be defined in a shape corresponding to the display PCB 50. The display PCB 50 may be inserted and mounted to a portion inside the display frame 60 that provides the frame light guide 61. Therefore, the display PCB 50 may maintain an accurate mounting position such that the light emitting parts 513 and 514 can be aligned with the guide holes 614 and 615 of the frame light guide 61.

The frame light guide 61 can maintain a state of being in close contact with the display PCB 50, and, therefore, light emitted from the light emitting parts 513 and 514 can be restricted from leaking between the display frame 60 and the display PCB 50.

In some implementations, a first upper end extension part 621 extending outward is provided at the upper end of the first side extension part 62, and a second upper end extension part 631 extending outward is provided at the upper end of the second side extension part 63. The first and second upper end extension parts 621 and 631 may extend in a direction away from each other.

The accommodating part 68 may include a lower opening 681. The lower opening 681 may restrict interference with the sensor assembly mounting part 37 in the process of mounting the display frame 60, and allow the sensor assembly mounting part 37 to be accommodated in the accommodating part 68.

Referring to FIG. 9, a pressing protrusion 636 may be formed at an approximately central portion of each of the first side extension part 62 and the second side extension part 63. The pressing protrusion 636 may protrude rearward from the rear surface of each of the first side extension part 62 and the second side extension part 63, and may contact the rear surface 33 of the display cover 30 when the display assembly 40 is inserted into the display cover 30.

The pressing protrusions 636 may be positioned between the upper end and the lower end of the frame light guide 61 along a vertical direction. That is, the pressing protrusions 636 may be positioned at opposite sides of the frame light guide 61, respectively.

Therefore, the display frame 60 may be pressed forward by the pressing protrusion 636, and the frame light guide 61 may maintain a state of being in closer contact with the rear surface of the cover front surface 31 of the display cover 30.

One or more coupling protrusions 64 may be formed on the rear surface of the frame light guide 61 and protrude rearward. The coupling protrusions 64 may be formed at positions corresponding to the coupling holes 520 of the display PCB 50. In particular, the coupling protrusions 64 may protrude from the rear surface of the frame light guide 61 and may extend to pass through the coupling holes 520 respectively.

The coupling protrusions 64 may be integrally formed when the display frame 60 is molded. Therefore, the coupling protrusions 64 may be injection-molded using a plastic material like the display frame 60. The end of the coupling protrusion 64 may protrude rearward from the display PCB 50 when the coupling protrusion 64 passes through the coupling hole 520.

The end of the coupling protrusion 64 that passes through the coupling hole 520 may be fused and fixed to the circumference of the coupling hole 520. Such a coupling structure allows the display frame 60 and the display PCB 50 to be be very firmly fixed to each other, and further allow the frame light guide 61 to be coupled to the display PCB 50 in close contact with each other.

In some implementations, the display frame 60 may further include a first guide 618 disposed between the first side extension part 62 and the second side extension part 63. The first side extension part 62 and the second side extension part 63 may be slidingly mounted on the display cover 30.

In order to restrict light from leaking between the frame light guide 61 and the cover front surface 31, the frame light guide 61 has to be in close contact with the rear surface of the cover front surface 31.

In the present implementation, the frame light guide 61 and the accommodating part 68 are positioned between the first side extension part 62 and the second side extension part 63. Therefore, the first guide 618 may be provided in the frame light guide 61 or the accommodating part 68, and configured to allow the frame light guide 61 to come into close contact with the rear surface of the cover front surface 31.

Referring to FIG. 10, the accommodating part 68 may include a space 682 in which the sensor assembly mounting part 37 is positioned. The circumferential wall 612 is formed in a portion of the space 682. Another portion of the space 682 is defined by a side wall 613. Still another portion of the space 682 is defined by a rear wall 683. Therefore, the rear wall 683 in the display frame 60 may be positioned behind the frame light guide 61. Alternatively or in addition, the accommodating part 68 may be formed as a portion of the frame light guide 61 is recessed rearward.

The side wall 613 is connected to the second side extension part 63 and disposed to face the circumferential wall 612.

The first guide 618 may include, for example, an extension part 618*a* extending in a horizontal direction from the frame light guide 61 toward the space 682, and a first protrusion 618*b* extending from the extension part 618*a* toward the rear wall 683 in a direction crossing the extension part 618*a*. The first protrusion 618*b* is spaced apart from the rear wall 683 such that a gap exists between the first protrusion 618*b* and the rear wall 683.

Figure 11:
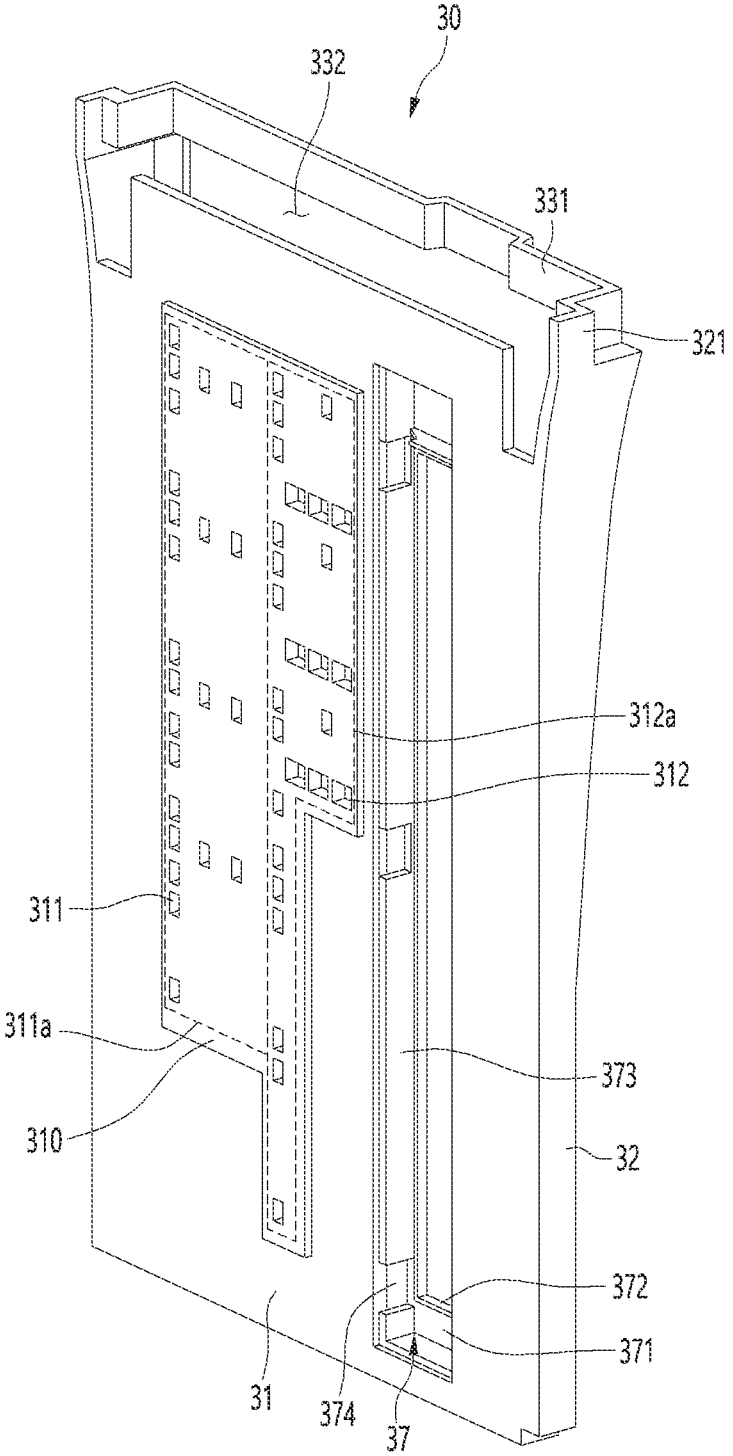
FIG. 11 is a front perspective view of the display cover.
Figure 12:
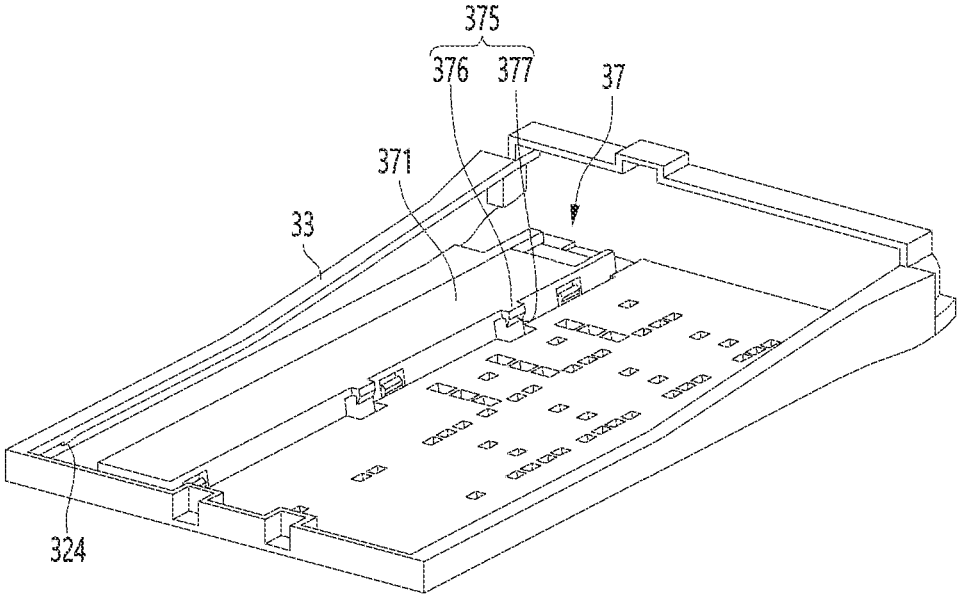
FIG. 12 is a rear perspective view of the display cover.

FIG. 11 is a perspective view of the display cover 30, when viewed from the front, according to the present implementation, and FIG. 12 is a perspective view of the display cover 30, when viewed from the rear, according to the present implementation.

Referring to FIGS. 11 and 12, the display cover 30 may include a cover light guide 310 that defines a plurality of through holes 311 and 312.

The cover light guide 310 may include a first through hole group 311*a* and a second through hole group 312*a*. The first through hole group 311*a* may include a plurality of through holes 311, and the second through hole group 311*b* may include a plurality of through holes 312.

The first through hole group 311*a* corresponds to the first light emitting group 511, the first guide group 614*a*, and the first display group 211*a*. The second through hole group 312*a* corresponds to the second light emitting group 512, the second guide group 615*a*, and the second display group 211*b*.

The frame light guide 61 may be disposed at a position corresponding to the cover light guide 310. A portion of the cover light guide 310 covers the entire second guide 616. Therefore, when the display frame 60 is mounted on the door, the second light guide 616 is not exposed to the outside.

The display cover 30 may further include a cover circumferential wall 32. The cover circumferential wall 32 may include an inlet part 321. The inlet part 321 defines the upper portions of both side surfaces of the cover circumferential wall 32 and may extend outward toward the upper side. That is, the width of the opened upper surface of the display cover 30 may be greater than the horizontal width of the display assembly 40. Therefore, the display assembly 40 can be easily inserted into the display cover 30 from above.

Referring to FIG. 12, the cover rear surface 33 defines the rear surface of the display cover 30 and may be formed along the rear end of the cover circumferential wall 32. The cover rear surface 33 is formed to have a predetermined width along the cover circumferential wall 32. Therefore, the center of the cover rear surface 33 may be entirely opened to expose the rear surface of the display assembly 40 inserted into the display cover 30.

A cover connection part 331 may be formed at the upper end of the cover rear surface 33. The cover connection part 331 connects the upper ends of both side surfaces of the cover circumferential wall 32.

The cover connection part 331 may serve to guide the display assembly 40 toward the inside of the display cover 30 when the display assembly 40 is inserted into the display cover 30. In this case, the cover connection part 331 may be coupled to the cover circumferential wall 32 while both ends thereof are bent forward. Therefore, it is possible to secure the width of the entrance in the front-and-rear direction into which the display assembly 40 can be inserted.

The first side extension part 62 and the second side extension part 63 may be inserted into a space between the rear surface of the cover light guide 310 and the cover rear surface 33. A cover protrusion 324 may be provided on the cover rear surface 33 and configured to press the first and second side extension parts 62 and 63 toward the cover light guide 310. The cover protrusion 324 presses the rear surface of each of the side extension parts 62 and 63, such that the frame light guide 61 is in close contact with the rear surface of the cover light guide 310.

A sensor assembly mounting part 37 may be further formed on the front surface of the display cover 30. The sensor assembly mounting part 37 may be positioned at the side of the cover light guide 310.

As an example, the sensor assembly mounting part 37 may be formed as a portion of the cover front surface 31 is recessed rearward.

The sensor assembly mounting part 37 may include a mounting wall 371 and a circumferential wall 373 formed in the circumference of the mounting wall 371.

The touch sensor assembly 70 may be seated on the mounting wall 371. For example, the elastic member 72 may be seated on the mounting wall 371. A mounting rib 372 for mounting the elastic member 72 may be formed on the mounting wall 371. The mounting rib 372 may be disposed to surround the outer circumference of the elastic member 72. Therefore, the elastic member 72 may be inserted into a space defined by the mounting rib 372, and the circumference of the elastic member 72 may be supported by the mounting rib 372.

When the elastic member 72 is mounted inside the sensor assembly mounting part 37, the touch PCB 71 may be supported by the front surface of the elastic member 72. The touch cover 73 may be mounted to shield the opened front surface of the sensor assembly mounting part 37. In this case, the touch sensor 712 of the touch PCB 71 may be pressed by the elastic member 72 so as to be in close contact with the rear surface of the touch cover 73.

The opened front surface of the sensor assembly mounting part 37 may have a size corresponding to the touch cover 73. Therefore, the touch cover 73 may shield the sensor assembly mounting part 37.

In some implementations, hook holes 374 may be further defined in the circumferential wall 373. The hook holes 374 may be opened such that the cover hooks 732 formed on both side surfaces of the touch cover 73 are inserted thereinto. In this case, the hook hole 374 may be elongated in the front-and-rear direction such that the touch cover 73 is movable in the front-and-rear direction.

Therefore, when the user presses the touch operation module 212, the outer plate 21 may be slightly elastically deformed while being pressed, and the touch cover 73 may apply pressure to the touch sensor 712 while being slightly pushed rearward. Due to the shape of the cover hook 732 and the hook hole 374, the touch cover 73 may be movable rearward, such that the touch sensor 712 is more easily recognized or actuated.

Referring to FIG. 12, the seating wall 371 may include a second guide 375 that can be aligned with the first guide 618 when the display frame 60 is coupled to the display cover 30.

Figure 15:
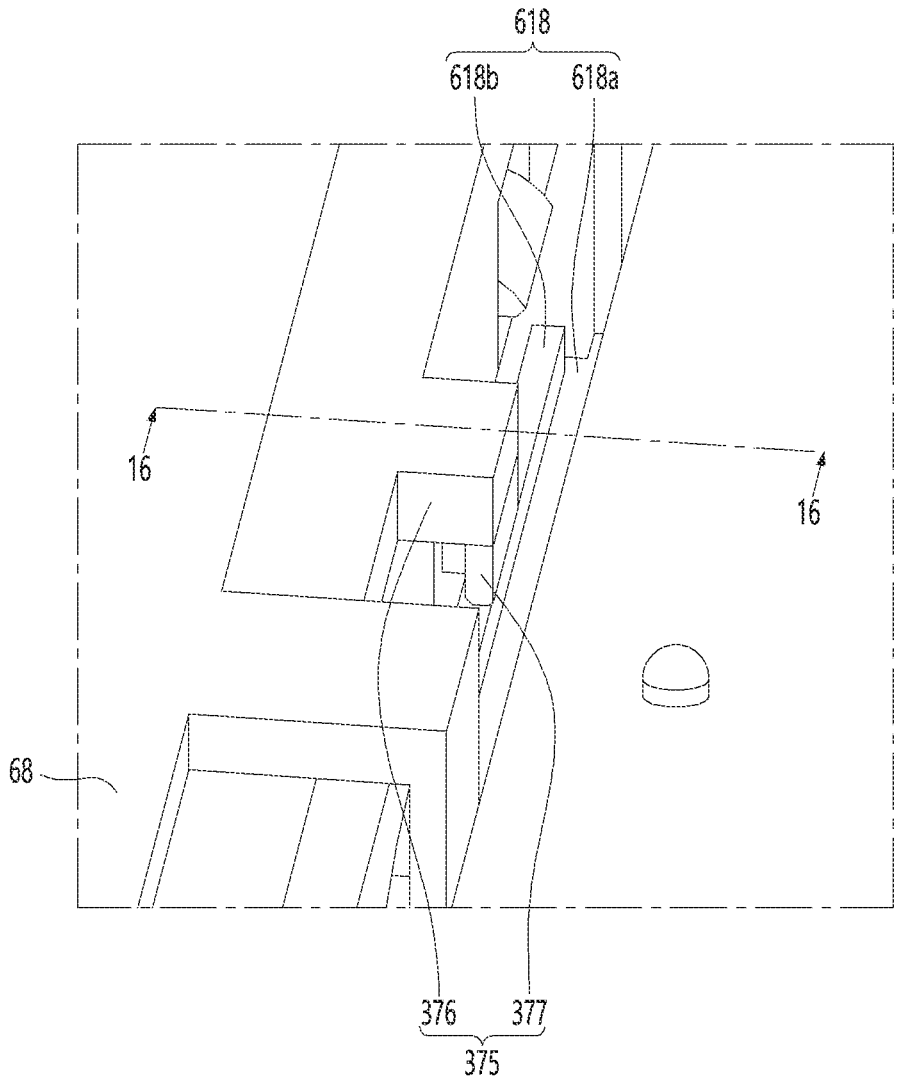
FIG. 15 illustrates that a first guide of the display frame and a second guide of the display cover are aligned with each other.
Figure 16:
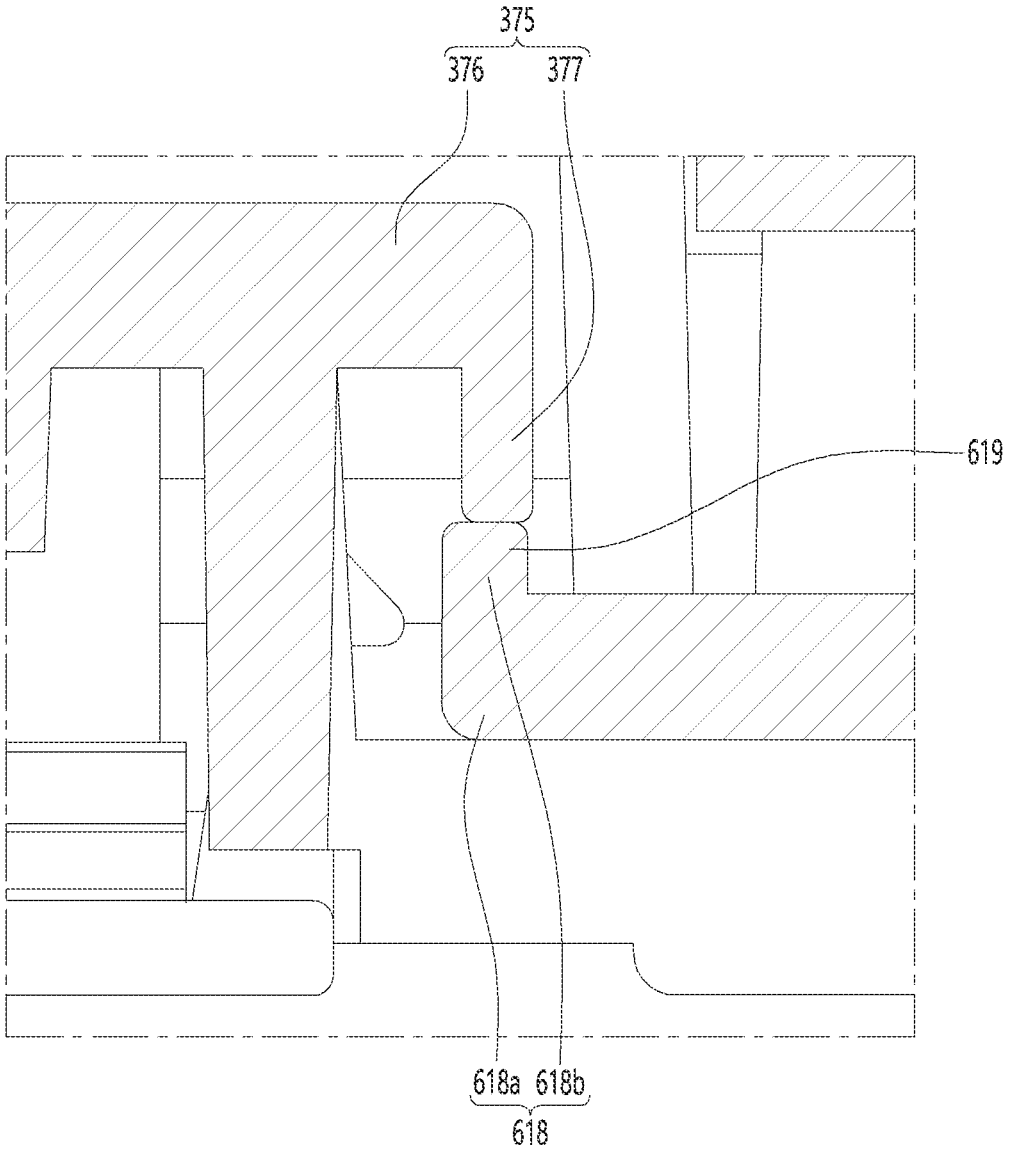
FIG. 16 is a cross-sectional view of the structure of FIG. 15, taken along line 16-16 of FIG. 15.

As shown in, for example, FIGS. 15 and 16, the first guide 618 may include an extension part 376 extending horizontally from the seating wall 371, and a second protrusion 377 extending from the extension part 376 in a direction crossing the extension part 376. For example, the second protrusion 377 may extend toward the rear surface of the cover light guide 310.

The cover light guide 310 is positioned at a side of the seating wall 371, and the extension part 376 may extend from the seating wall 371 toward the cover light guide 310. The extension part 376 is substantially parallel to the cover light guide 310, and the second protrusion 377 protrudes from the extension part 376 in a direction closer to the rear surface of the cover light guide 310.

Figure 13:
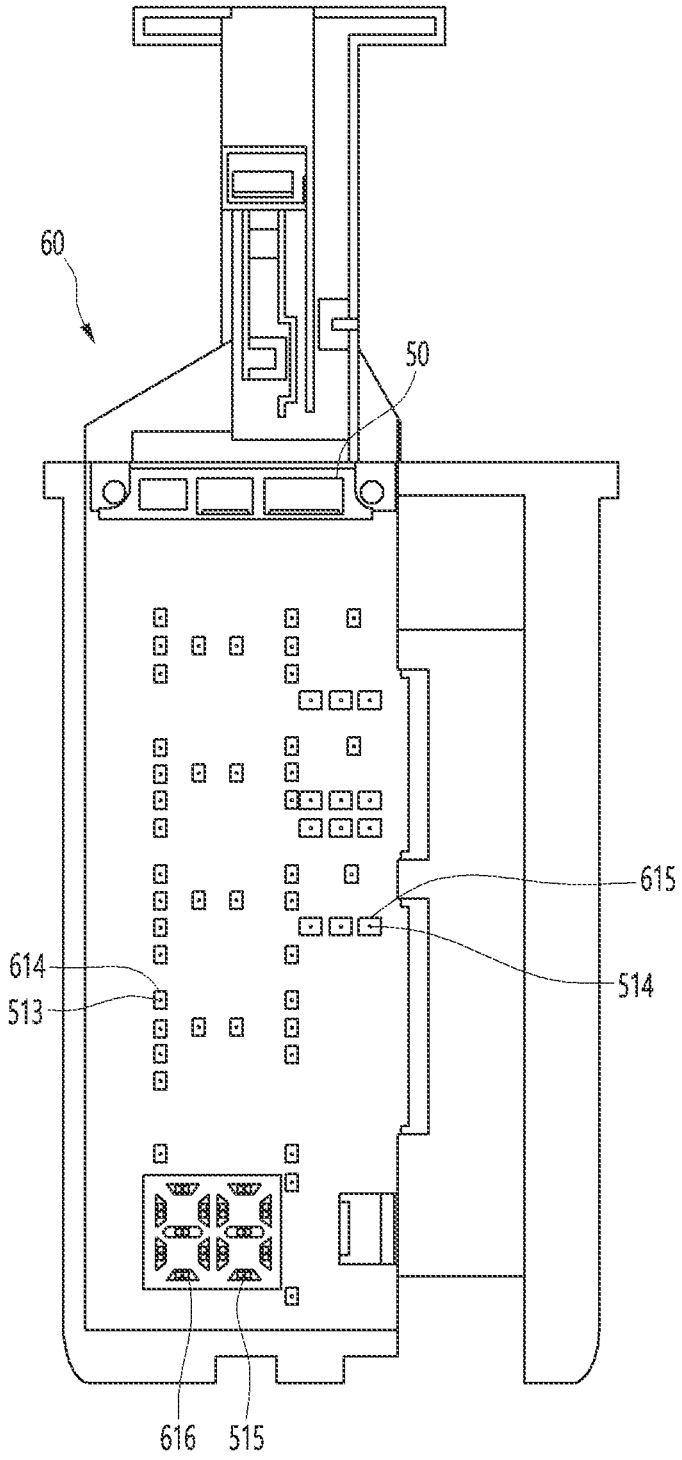
FIG. 13 illustrates that the display PCB is coupled to the display frame.
Figure 14:
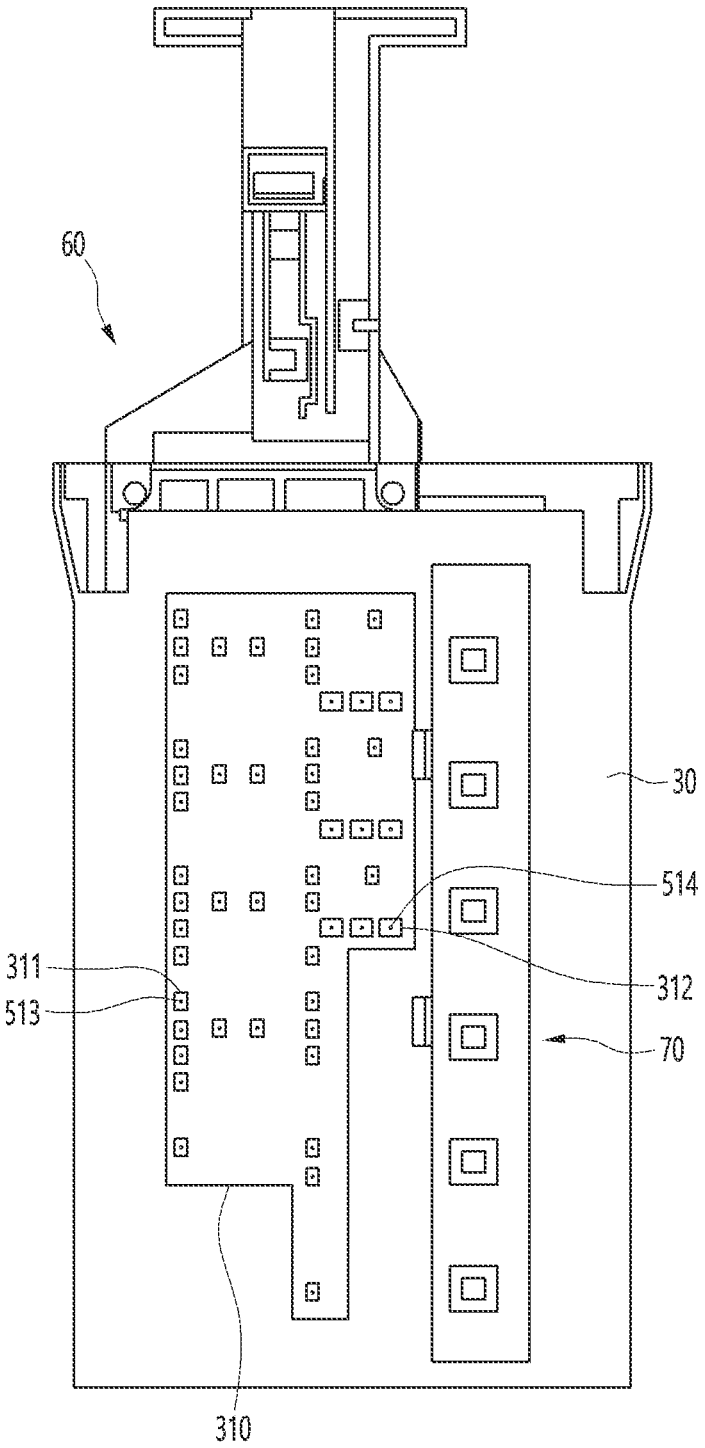
FIG. 14 illustrates that the display frame is coupled to the display cover.

FIG. 13 illustrates that the display PCB is coupled to the display frame according to the present implementation, and FIG. 14 illustrates the display frame is coupled to the display cover.

First, referring to FIG. 13, when the display PCB 50 is coupled to the display frame 60, the light emitting parts 513 and 514 of the first display 510 are aligned with the guide holes 614 and 615 of the first light guides 614*a* and 615*a* of the frame light guide 61. In addition, the light emitting part 515 of the second display 516 is aligned with the guide hole of the second light guide 616.

Next, referring to FIG. 14, when the display frame 60 is coupled to the display cover 30, the light emitting parts 513 and 514 of the first display 510 are aligned with the guide holes 614 and 615 of the first light guides 614*a* and 615*a* and the through holes 311 and 312 of the cover light guide 310.

In addition, the light emitting part 515 of the second display 516 is not aligned with the cover light guide 310. That is, the cover front surface 31 covers the second display 516. Therefore, when the light emitting part 515 of the second display 516 is turned on, the light emitted from the light emitting part 515 does not pass through the cover front surface 31.

According to implementations of the present disclosure, it may not be necessary to form a seven-segment-shaped through hole corresponding to the second display 516 in the outer plate 21. Therefore, the number of through holes defined in the outer plate is reduced, such that an aesthetic sense is improved and the process of manufacturing the outer plate is simplified.

FIG. 15 illustrates that a first guide of the display frame and a second guide of the display cover are aligned with each other, and FIG. 16 is a cross-sectional view taken along line 16-16 of FIG. 15.

Referring to FIGS. 15 and 16, when the display frame 60 is slidingly coupled to the display cover 30, the first guide 618 is positioned between the second guide 375 and the cover front surface 31.

With the extension parts 376 and 618*a* of each guide, the first protrusion 618*b* of the first guide 618 is aligned with the second protrusion 377 of the second guide 375. For example, the first protrusion 618*b* and the second protrusion 377 may contact each other.

According to this structure, the frame light guide 611 may be in close contact with the rear surface of the cover light guide 310, such that the light emitted from the light emitting parts 513 and 514 of the first display 510 is restricted from leaking through a gap between the frame light guide 611 and the cover light guide 310.

Figure 17:
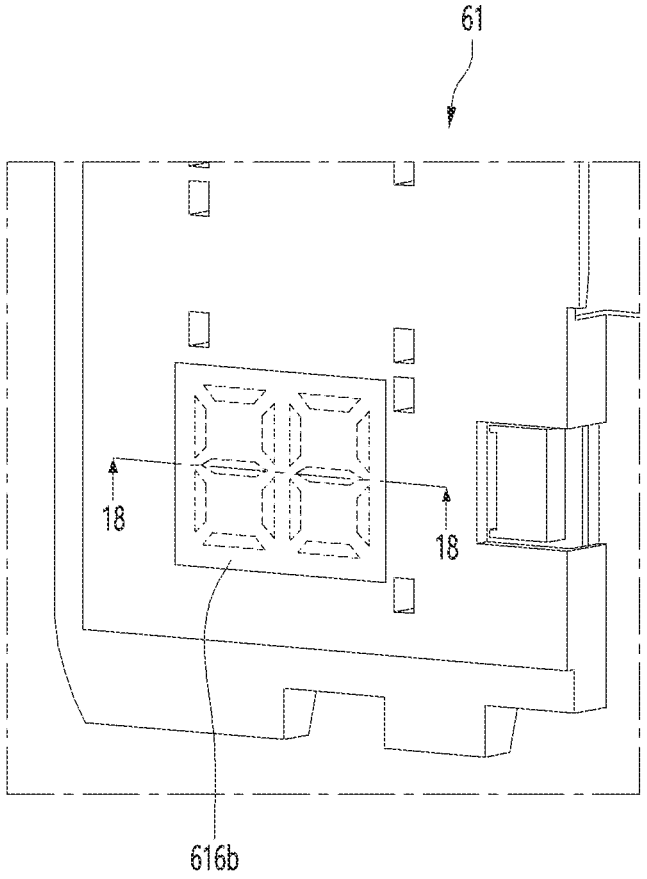
FIG. 17 illustrates that a diffusion sheet is attached to the display frame.
Figure 18:
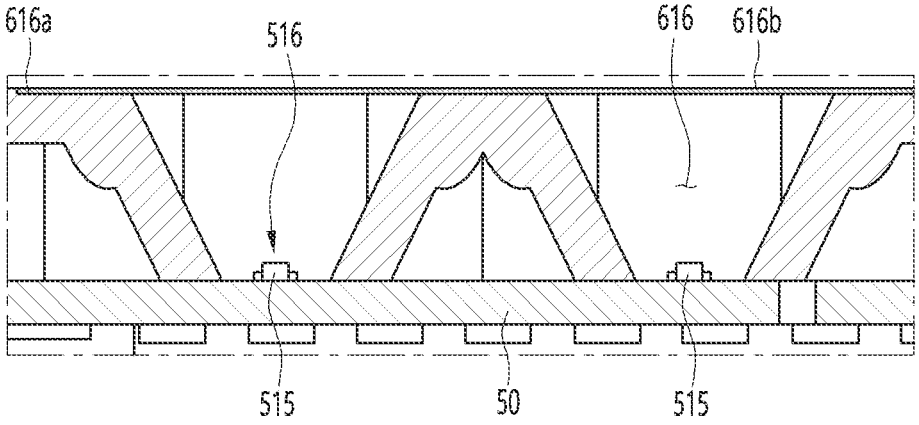
FIG. 18 is a cutaway cross-sectional view of the structure of FIG. 17, taken along line 18-18 of FIG. 17.

FIG. 17 illustrates that a diffusion sheet is attached to the display frame according to the present implementation, and FIG. 18 is a cutaway cross-sectional view taken along line 18-18 of FIG. 17.

Referring to FIGS. 17 and 18, the second display 516 does not operate when the display assembly 40 is mounted on the door 20. The second display 516 can operate when the display assembly 40 is separated from the door 20 such that information is provided to the user.

Therefore, even when the light emitting part 515 of the second display 516 is turned on while the display assembly 40 is separated from the door 20 and the second light guide 616 of the display frame 60 is directly exposed to the outside, light passing through at least some guide holes of the second light guide 616 may not be accurately recognized.

In some implementations, a diffusion sheet 616*b* may be attached to a position corresponding to the second light guide 616 in the display frame 60, such that the position of the light emitted from the light emitting part 515 of the second display 516 can be accurately identified.

The diffusion sheet 616*b* may be seated on the seating groove 616*a*. As the diffusion sheet 616*b* is seated on the mounting groove 616*a*, the diffusion sheet 616*b* may be restricted from protruding frontward from the display frame 60. When the diffusion sheet 616*b* is restricted from protruding frontward from the display frame 60, the frame light guide 611 may be restricted from being separated from the cover light guide 310.

In some implementations, information that is not displayed on the first display 510 may be displayed on the second display 516. For example, the second display 516 may be configured to display test result information of a control program for allowing the user to control the refrigerator, display a mode during an operation test of the refrigerator, or display mode information that operates during a program update process. The second display 516 may display the information in the form of numerals and/or letters.

Figure 19:
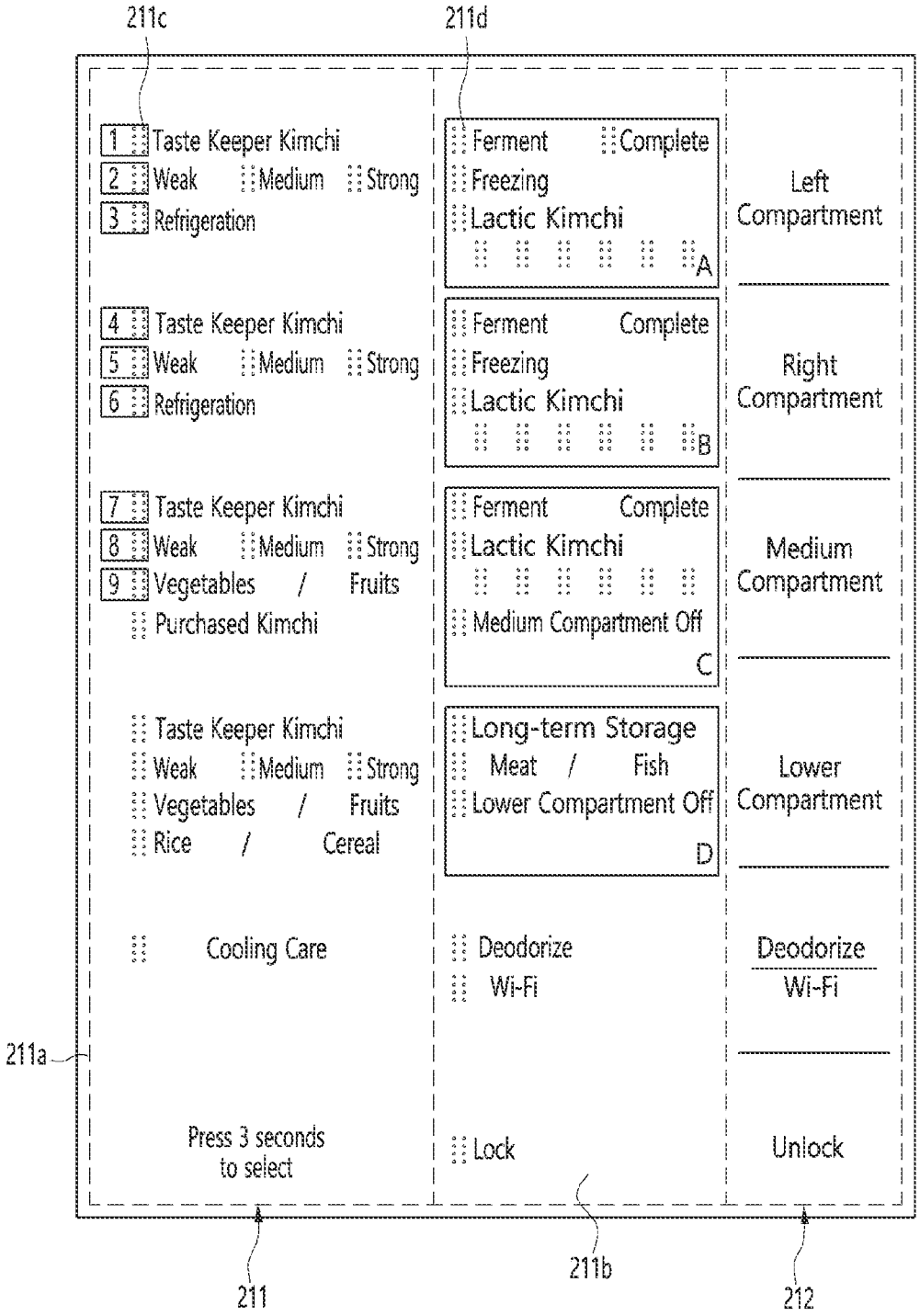
FIG. 19 illustrates that a region is divided for displaying an error code in a first display group and a second display group.
Figure 20:
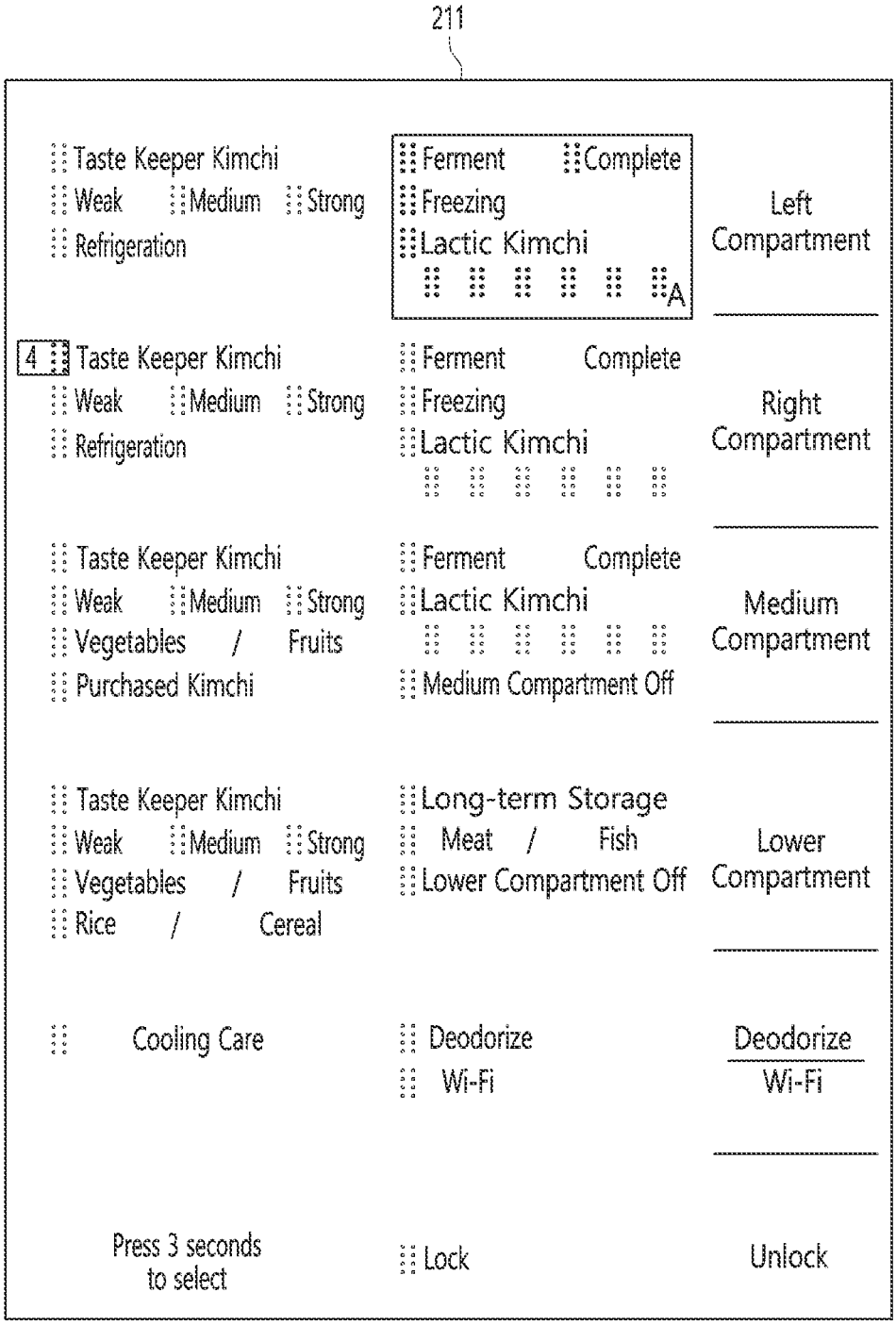
FIG. 20 illustrates an example display of a specific error code.

FIG. 19 illustrates that a region is divided for displaying an error code in the first display group and the second display group, and FIG. 20 illustrates that a specific error code is displayed.

Referring to FIGS. 3, 7, 19, and 20, in the present implementation, the first display 510 may not only display the current state of the refrigerator, but also display an error code when an error occurs.

For example, the first display group 211*a* and the second display group 211*b* do not include a seven-segment form. Therefore, information cannot be displayed in each of the first and second display groups 211*a* and 211*b* in the form of numerals or letters. However, an operator can recognize the error code by checking the positions of the light transmitted from the first display group 211*a* and the second display group 211*b*.

In some implementations, as shown in FIG. 19, a plurality of transmission parts 211*c* may be vertically arranged in the first display group 211*a*. The plurality of transmission parts 211*c* of the first display group 211*a* may be sequentially numbered from above, for example. Therefore, when light is transmitted from a specific transmission part among the plurality of transmission parts 211*c*, a number assigned to the transmission part 211*c* may actually correspond to number information for displaying the error code.

Also, in the second display group 211*b*, the plurality of transmission parts 211*d* may be divided into a plurality of display areas. The plurality of display areas are arranged vertically, and letters may be sequentially assigned from above. For example, as shown in FIG. 19, the second display group 211*b* is divided into four display areas, and may be divided into areas A, B, C, and D from above.

The error code can be displayed as shown in FIG. 20 based on division of the area and further on assigned numbers of the transmission parts.

For example, when light is transmitted from the fourth transmission part from above in the first display group and light is transmitted from one or more transmission parts included in the area A, the user can confirm that the error code is 4A. Therefore, the operator can check the error code without forming the through holes for displaying the error code on the outer plate.

The above description is merely illustrative of the technical idea of the present disclosure, and various modifications and changes may be made thereto by those skilled in the art without departing from the essential characteristics of the present disclosure. Therefore, the implementations of the present disclosure are not intended to limit the technical spirit of the present disclosure but to describe the technical idea of the present disclosure, and the technical spirit of the present disclosure is not limited by these implementations. The scope of protection of the present disclosure should be interpreted by the appending claims, and all technical ideas within the scope of equivalents should be construed as falling within the scope of the present disclosure.

What is claimed is:

1. A refrigerator comprising:

a cabinet defining a storage space;

a door configured to open or close the storage space, the door including an inner case and a display cover;

a display assembly detachably coupled to the door, the display assembly being received in the inner case and mounted on the display cover; and a display window disposed at a front surface of the door, the display window including a transmission part configured to transmit light therethrough, wherein the display assembly comprises (i) a first display disposed at a first position that corresponds to the transmission part and (ii) a second display disposed at a second position that is different from the first position, wherein each of the first display and the second display includes a plurality of light emitting parts, wherein the door further comprises a display frame including:

a first light guide configured to guide light of the plurality of light emitting parts of the first display, and a second light guide configured to guide light of the plurality of light emitting parts of the second display, wherein the display cover comprises a cover light guide that corresponds to the first light guide, and wherein, based on the display assembly being mounted at the display cover, the first light guide is aligned with the cover light guide and the second light guide is covered by and hidden behind a cover front surface of the display cover.

2. The refrigerator of claim 1, wherein the display assembly comprises:

a display printed circuit board (PCB) that includes the first display and the second display; and wherein the display PCB is mounted on the display frame.

3. The refrigerator of claim 2, wherein the first display is configured to display an operating state of the refrigerator and an error code, and wherein the second display is configured to display at least one of (i) test result information of a control program configured to control the refrigerator, (ii) a mode during an operation test of the refrigerator, or (iii) mode information during a program update process.

4. The refrigerator of claim 1, wherein each of the first light guide and the second light guide comprises a plurality of guide holes, and wherein the plurality of guide holes of the second light guide is disposed in a seven-segment form.

5. The refrigerator of claim 1, wherein the display frame further comprises a diffusion sheet disposed at a position that corresponds to the second light guide.

6. The refrigerator of claim 5, wherein the display frame defines a seating groove, wherein the second light guide is positioned at the seating groove, and wherein the diffusion sheet is seated at the seating groove and covers the second light guide.

7. The refrigerator of claim 1, wherein the display assembly is configured to slide with respect to the display cover to be mounted to the display cover, and wherein the display cover comprises a cover circumferential surface, the cover front surface including the cover light guide that corresponds to the first light guide.

8. The refrigerator of claim 7, wherein the display cover comprises:

a sensor assembly mounting part being disposed at a side of the cover light guide and mounting a touch sensor assembly; and the cover circumferential surface extending from a circumference of the cover front surface, and wherein the display frame comprises (i) a frame light guide disposed at a position corresponding to the cover light guide, and (ii) an accommodating part disposed at a first side of the frame light guide and configured to accommodate the sensor assembly mounting part.

9. The refrigerator of claim 8, wherein the sensor assembly mounting part is recessed from the cover front surface.

10. The refrigerator of claim 8, wherein the display cover comprises a cover rear surface extending from the cover circumferential surface and spaced apart from the cover front surface, wherein the display frame comprises (i) a first side extension part disposed at a second side of the frame light guide, the second side being opposite to the first side of the frame light guide, and (ii) a second side extension part disposed at a side of the accommodating part, and wherein each of the first side extension part and the second side extension part is configured to slide and be inserted into a space between the cover front surface and the cover rear surface.

11. The refrigerator of claim 10, wherein the cover rear surface includes a cover protrusion configured to press the first side extension part and the second side extension part toward the cover light guide.

12. The refrigerator of claim 11, wherein the display frame further comprises a first guide disposed between the first side extension part and the second side extension part, and wherein the display cover further comprises a second guide aligned with the first guide based on the display frame being mounted at the display cover.

13. The refrigerator of claim 10, wherein the first side extension part and the second side extension part include a pressing protrusion configured to contact the cover rear surface.

14. The refrigerator of claim 13, wherein the display frame further comprises a first guide disposed between the first side extension part and the second side extension part, and wherein the display cover further comprises a second guide aligned with the first guide based on the display frame being mounted at the display cover.

15. The refrigerator of claim 14, wherein the first guide comprises (i) a first extension part extending from the frame light guide toward the accommodating part, and (ii) a first protrusion extending in a first direction crossing the first extension part, wherein the second guide comprises (i) a second extension part extending from a mounting wall that receives the touch sensor assembly, and (ii) a second protrusion extending from the second extension part in a second direction crossing the second extension part, and wherein, based on the display frame being mounted at the display cover, the first protrusion is aligned with the second protrusion.

16. The refrigerator of claim 1, wherein the display window comprises a first display group and a second display group, the second display group being separated from the first display group, wherein each of the first display group and the second display group comprises a plurality of transmission parts, and wherein the first display group is configured to display, based on an operation of the first display, first information, and wherein the second display group is configured to display, based on the operation of the first display, second information.

17. The refrigerator of claim 16, wherein the first information is configured to include one or more numerals or one or more letters, and wherein the second information is configured to, based on the first information including the one or more numerals, include the one or more letters, and configured to, based on the first information including the one or more letters, include the one or more numerals.

18. A refrigerator comprising:

a cabinet defining a storage space;

a door configured to open or close the storage space, the door including an inner case and a display cover;

a display assembly coupled to the door and configured to be detached from the door; and a display window disposed at a front surface of the door, the display window including a transmission part configured to transmit light therethrough, wherein the display assembly comprises (i) a first display disposed at a first position that corresponds to the transmission part and configured to display first information, and (ii) a second display configured to display second information that is different from the first information, wherein each of the first display and the second display includes a plurality of light emitting parts, wherein the door further comprises a display frame including:

a first light guide configured to guide light of the plurality of light emitting parts of the first display, and a second light guide configured to guide light of the plurality of light emitting parts of the second display, wherein the display cover comprises a cover light guide that corresponds to the first light guide, wherein, based on the display assembly being mounted at the display cover, the first light guide is aligned with the cover light guide and the second light guide is covered by and hidden behind a cover front surface of the display cover, wherein the first display is configured to operate based on the display assembly being coupled to the door, and wherein the second display is configured to operate based on the display assembly being detached from the door.

* * * * *